US011018466B2

(12) United States Patent
Zhu et al.

(10) Patent No.: US 11,018,466 B2
(45) Date of Patent: May 25, 2021

(54) ELECTRICAL POWER TRANSMISSION AND OUTLET SYSTEM

(71) Applicant: SHANUTEC (SHANGHAI) CO., LTD., Shanghai (CN)

(72) Inventors: Wenting Zhu, Shanghai (CN); Nan Luo, Shanghai (CN); Bowei Lu, Shanghai (CN); Chao Du, Shanghai (CN); Xiaoqiao Shen, Shanghai (CN); Xiaoyu Wang, Shanghai (CN); Yan Chen, Shanghai (CN)

(73) Assignee: SHANUTEC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/851,128

(22) Filed: Apr. 17, 2020

(65) Prior Publication Data

US 2020/0274306 A1 Aug. 27, 2020

Related U.S. Application Data

(63) Continuation of application No. 15/752,244, filed as application No. PCT/CN2016/087864 on Jun. 30, 2016, now Pat. No. 10,630,035.

(30) Foreign Application Priority Data

| | | |
|---|---|---|
| Aug. 19, 2015 | (CN) | 201510511544.9 |
| Dec. 16, 2015 | (CN) | 201510947233.7 |
| May 27, 2016 | (CN) | 201620498030.4 |

(51) Int. Cl.
*H01R 25/14* (2006.01)
*H01R 13/717* (2006.01)
(Continued)

(52) U.S. Cl.
CPC ..... *H01R 25/142* (2013.01); *H01R 13/24* (2013.01); *H01R 13/506* (2013.01);
(Continued)

(58) Field of Classification Search
CPC .... H01R 25/14; H01R 25/142; H01R 25/145; H01R 25/147
See application file for complete search history.

(56) References Cited

U.S. PATENT DOCUMENTS 5,052,937 A 10/1991 Glen
5,183,406 A * 2/1993 Glen ..... H01R 25/14 439/120
(Continued)

FOREIGN PATENT DOCUMENTS

CN 2319934 Y 5/1999
CN 2904381 Y 5/2007
(Continued)

OTHER PUBLICATIONS

Notice of Rejection in Japanese Application No. 2018-508737 dated Jun. 18, 2019, 6 pages.
(Continued)

*Primary Examiner* — Ross N Gushi
(74) *Attorney, Agent, or Firm* — Metis IP LLC

(57) ABSTRACT

The present disclosure relates to a socket. The socket may include a housing and a plug. At least one of a slot or a hole may be positioned on at least one side of the housing. A clamping conducting strip may be positioned in the housing. At least two elastic conducting contacts may be positioned on a surface of plug. The elastic conducting contacts may connect to a power source and the plug may be positioned outside the housing. A connecting groove may be positioned on a back side of the housing. An inner contact point may be positioned in the connecting groove and be connected to the
(Continued)

clamping conducting strip. A connector may be positioned in the plug. An external contact point may be positioned on the connector. The external contact point may be connected to the elastic conducting contact. The connector may be inserted into the connecting groove.

15 Claims, 22 Drawing Sheets

(51) Int. Cl.

| | |
|---|---|
| ***H01R 13/24*** | (2006.01) |
| ***H01R 13/506*** | (2006.01) |
| ***H01R 25/00*** | (2006.01) |
| *H01R 13/22* | (2006.01) |
| *H01R 13/508* | (2006.01) |
| *H01R 13/502* | (2006.01) |
| *H01R 13/11* | (2006.01) |
| *H01R 24/76* | (2011.01) |

(52) U.S. Cl.
CPC ..... *H01R 13/717* (2013.01); *H01R 25/006* (2013.01); *H01R 13/11* (2013.01); *H01R 13/22* (2013.01); *H01R 13/502* (2013.01); *H01R 13/508* (2013.01); *H01R 24/76* (2013.01); *H01R 25/145* (2013.01)

(56) References Cited

U.S. PATENT DOCUMENTS

| | | | | |
|---|---|---|---|---|
| 6,521,834 | B1 | 2/2003 | Dykhoff et al. | |
| 7,220,136 | B1 * | 5/2007 | Green | H01R 25/00 439/106 |
| 7,481,658 | B2 | 1/2009 | Jong | |
| 7,556,511 | B1 | 7/2009 | Hsu et al. | |
| 7,972,146 | B2 | 7/2011 | Busse | |
| 9,142,911 | B1 | 9/2015 | Kao et al. | |
| 9,407,030 | B2 | 8/2016 | Zanotto | |
| 9,929,554 | B2 * | 3/2018 | Ross | H01R 43/26 |
| 2007/0212908 | A1 | 9/2007 | Jong | |
| 2018/0294594 | A1 | 10/2018 | Manushi et al. | |

FOREIGN PATENT DOCUMENTS

| | | | |
|---|---|---|---|
| CN | 201266760 | Y | 7/2009 |
| CN | 201732948 | U | 2/2011 |
| CN | 203589401 | U | 5/2014 |
| CN | 20389636 | U | 9/2014 |
| CN | 203659355 | U | 10/2014 |
| CN | 104332786 | A | 2/2015 |
| CN | 204179441 | U | 2/2015 |
| CN | 105048232 | A | 11/2015 |
| CN | 204927751 | U | 12/2015 |
| CN | 105428858 | A | 3/2016 |
| CN | 205212002 | U | 5/2016 |
| CN | 105048232 | B | 5/2017 |
| FR | 2837323 | A1 | 9/2003 |
| GB | 2408854 | A | 6/2005 |
| JP | S52131194 | A | 11/1977 |
| WO | 8701524 | A1 | 3/1987 |
| WO | 1987001524 | A1 | 3/1987 |
| WO | 2008132593 | A2 | 11/2008 |
| WO | 2009153582 | A1 | 12/2009 |
| WO | 2017028633 | A1 | 2/2017 |

OTHER PUBLICATIONS

Examination Report in Australian Application No. 2016310269 dated Jul. 7, 2018, 3 pages.
First Examination Report in Indian Applicatio No. 201817008457 dated Nov. 18, 2019, 5 pages.
Search Report in Singapore Application No. 11201801336V dated Nov. 21, 2018, 3 pages.
Written opinion in Singapore Application No. 11201801336V dated Nov. 22, 2018, 3 pages.
International Search Report in PCT/CN2016/087864 dated Oct. 8, 2016, 8 pages.
First Office Action in Chinese Application No. 201510511544.9 dated Jan. 3, 2017, 16 pages.
First Office Action in Chinese Application No. 201510947233.7 dated Jul. 5, 2017, 15 pages.
The Second Office Action in Chinese Application No. 201510947233.7 dated Jan. 26, 2018, 16 pages.

* cited by examiner

ELECTRICAL POWER TRANSMISSION AND OUTLET SYSTEM

CROSS-REFERENCE TO RELATED APPLICATIONS

This application claims priority to: Chinese application No. 201510511544.9 filed on Aug. 19, 2015, Chinese Application No. 201510947233.7 filed on Dec. 16, 2015, and Chinese Application No. 201620498030.4 filed on May 27, 2016. Each of the above-referenced applications is incorporated herein by reference in its entirety.

TECHNICAL FIELD

The present disclosure relates to a power outlet system and, more particularly, to a power outlet system for home automation.

BACKGROUND

Smart home applications and technologies have become increasingly popular. Conventional home wiring and electrical systems may not be suitable for providing control and automation for such applications. For example, conventional power sockets are typically fixed in a conventional home wiring structure. In order to power a device or an appliance that is not in proximity to an outlet, extension cords or extension sockets are normally used. However, the additional cords and/or sockets may not only make a room look untidy but may also cause safety issues. In addition, installation of additional sockets in commonly used areas in a home may require complexed in-wall wiring. In addition, it may be difficult to predict the positons of these areas for decoration purpose.

SUMMARY

According to one aspect of the present disclosure, provided herein may be a socket. A socket may include a housing and a plug. At least one of a slot or a hole may be positioned on at least one side of the housing. A clamping conducting strip may be positioned in the housing. At least two elastic conducting contacts may be positioned on a surface of plug. The elastic conducting contacts may be configured to connect to a power source and the plug may be positioned outside the housing.

In some embodiments, a connecting groove may be positioned on a back side of the housing. An inner contact point may be positioned in the connecting groove. The inner contact point may be connected to the clamping conducting strip. A connector may be positioned in the plug. An external contact point may be positioned in on the connector. The external contact point may be connected to the elastic conducting contact. The connector may be configured to be inserted into the connecting groove.

In some embodiments, a retracting groove may be positioned on the back side of the housing. The connector may be configured to be inserted into the retracting groove to be in proximity to the back side of the housing.

In some embodiments, a connector may be positioned on the top of plug. A back plate may be positioned on a back end of the connector. A slot may be positioned on the back side of the housing. The connector may be configured to be inserted into the slot to place the back plate inside the housing and the plug outside the housing. The elastic conducting contact may be configured to be connected to the clamping conducting strip.

In some embodiments, the housing may comprise front housing and a rear housing. The slot may be positioned on the rear housing, and a spring may be positioned between the rear housing and the back plate.

In some embodiments, the plug may include a connecting conduct strip. A first end of connecting conduct strip may form an elastic conducting contact and a second other end of connecting conduct strip may be connected to the clamping conducting strip.

In some embodiments, a surface of the elastic conducting contact may be configured in a circular shape or a stepped shape.

In some embodiments, the at least one of the slot or the hole, or the clamping conducting strip can be replaced by an electrical device, including a router, a sensor, an alarm, a detector, a camera, a charger, or a converter.

In some embodiments, housing may further include an indicator light.

In some embodiments, the socket conforms with at least one of an international standard of International Electrotechnical Commission (IEC), a British standard, an American standard, a European standard, a South African standard, a United Arab Emirates standard, a Korean standard, an Indian standard, a Russian standard, or an Australian standard.

In some embodiments, the housing may be made of polyvinyl chloride (PVC).

In some embodiments, the plug may be made of a mixture of polyamide 66 (PA66) and 30% glass fiber.

In some embodiments, a cross sectional area of the elastic conducting contact may be within a range of 1.0 $mm^2$~3.0 $mm^2$.

In some embodiments, the housing may include a cavity configured to install an intelligent chip.

According to one aspect of the present disclosure, provided herein may be a system. The system may include a socket. The A socket may include a housing and a plug. At least one of a slot or a hole may be positioned on at least one side of the housing. A clamping conducting strip may be positioned in the housing. At least two elastic conducting contacts may be positioned on a surface of plug. The elastic conducting contacts may be configured to connect to a power source and the plug may be positioned outside the housing. The system may include a power strip system. The power outlet strip may include at least two conductors. The elastic conducting contacts may be connected to the conductors when the plug is configured to be inserted into the power outlet strip.

In some embodiments, the power strip system may further include a strip connector. The strip connector may establish a connection between two or more power outlet strips.

In some embodiments, the strip connector may include a connecting joint and a connecting interface.

In some embodiments, the connecting joint may include a first conductor, and the connecting interface may include a second conductor matching the first conductor.

In some embodiments, the first conductor may be a conducting bar and the second conductor may be a conducting tube.

In some embodiments, the connecting joint may include a first buckle and a first strip connector, and the first buckle and the first strip connector may be perpendicularly connected.

In some embodiments, the first strip connector may be connected to the power outlet strip by a third conductor.

In some embodiments, the third conductor may be a conducting bar.

In some embodiments, the connecting interface may include a second buckle and a second strip connector. The second conductor may be positioned on a first end of the second buckle. A second end of the second buckle and the second strip connector may be perpendicularly connected.

In some embodiments, a first end of the second strip connector may include a cavity. A fourth conductor configured to connect to the power outlet strip may be positioned in the cavity. The second strip connector may be connect to power outlet strip by the cavity.

In some embodiments, the fourth conductor may be a conducting bar.

In some embodiments, the conducting bar may comprises a lantern-shaped connector.

In some embodiments, the cross sectional area of the conductor may be within a range of 5.0 $mm^2$~7.0 $mm^2$.

BRIEF DESCRIPTION OF THE DRAWINGS

The disclosed subject matter can be more fully appreciated with reference to the following detailed description of the disclosed subject matter when considered in connection with the following drawings. The exemplary embodiments and illustrations are set fourth in order to provide a thorough understanding of the relevant disclosure, and is not intended to be limiting. The like reference numerals identify like elements in figures.

DETAILED DESCRIPTION

Figure 1A:
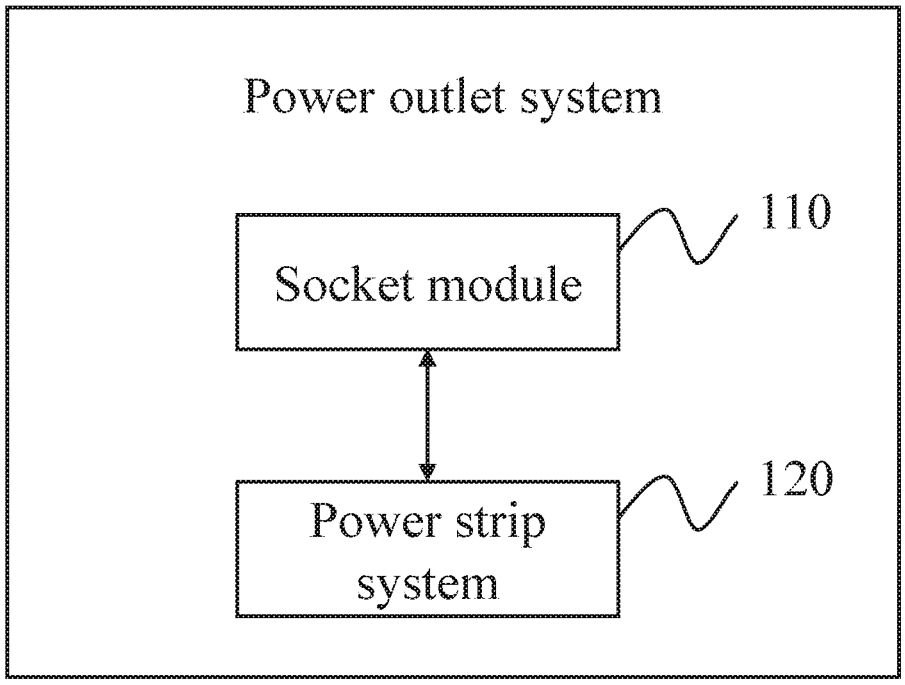
FIG. 1A illustrates an exemplary power outlet system in accordance with some embodiments of this disclosure.

In the following detailed description, numerous specific details are set fourth by way of examples in order to provide a thorough understanding of the relevant disclosure. However, it should be apparent to those skilled in the art that the present disclosure may be implemented in various alternative embodiments and alternative applications. Same reference numerals identify same elements or operations, unless the context clearly indicates otherwise.

As used herein, the singular forms "a," "an," and/or "the" may be intended to include the plural forms as well, unless the context clearly indicates otherwise. Generally, the terms "include," and/or "comprise," when used in this disclosure, specify the presence of steps and elements, but do not exclude the presence or addition of one or more other steps and elements.

As used herein, the terms "system", "module", "unit" and/or "component" are used to present the hierarchical relationships between structures, but do not have absolute meanings. It will be further understood that these terms can replace each other or can be replaced by other terms as it is needed.

FIG. 1A illustrates an exemplary power outlet system 100 in accordance with some embodiments of this disclosure. Power outlet system 100 may include one or more socket modules 110 and one or more power strip system 120. In some embodiments, power strip system 120 may include a power outlet strip. In some embodiments, power strip system 120 may include one or more power outlet strips and one or more strip connectors. The strip connectors can be arranged in any suitable manner to provide different applications. For example, two power outlet strips may be connected by a linear strip connector. As another example, two power outlet strips may be connected by a right angled connector, such as a female angled strip connector or a male angled strip connector. In some embodiments, two power outlet strips may be connected by a "⎍," shaped strip connector.

Power strip system 120 can be connected to a power source. Socket module 110 can be connected to power strip system 120 to receive a power supply. Power strip system 120 can be installed on the surface of a certain object (e.g., on the trims, ceilings or other locations on the walls in a room). Power strip system 120 can also be installed inside a certain object (such as furniture, electrical appliances, etc.) or inside walls. In this case, power strip system 120 may expose its connecting interface to connect socket module 110. Power outlet strip can also be installed in the home, or on office furniture (such as office desks). In some embodiments, multiple fixed sockets may be configured on the power outlet strip of power strip system 120. The fixed sockets may be configured for certain electrical appliances. For example, refrigerators, air conditionings, water heaters and other electrical appliances that are normally installed in fixed locations can be directly connected to (e.g., electrically connected to) fixed sockets in the power outlet strip of power strip system 120.

Power outlet strip can be connected to (e.g., electrically connected to) one or more socket modules 110. In some embodiments, the socket module 110 may include a socket (also referred to as a switch socket). A plug of an electrical appliance can be inserted into the socket to receive a power supply. In some embodiments, socket module 110 can be replaced by other electrical devices such as a router, a sensor, an alarm, a detector, a camera, a charger or a converter, the like, or any combination thereof.

Power strip system 120 may include two or more conductors. In some embodiments, each of the conductors can be and/or include a conductive wire, such as a hot wire, a ground wire, or a neutral wire. Socket module 110 and power strip system 120 can be electrically connected by the conductors in the power strip system 120. In some embodiments, socket module 110 can be connected to (e.g., electrically connected to) a hot wire and a neutral wire in the power strip system 120. In some embodiments, socket module 110 can be connected to (e.g., electrically connected to) a hot wire, a ground wire, and a neutral wire in the power strip system 120.

In some embodiments, socket module 110 may include a plug 220. The power outlet strip in the power strip system 120 may include one or more slots or holes. The plug of socket module 110 can be inserted into the insertion groove of power strip system 120 to receive a power supply. In some embodiments, the depth of insertion groove can be greater than the insertion depth of plug 220 of socket module 110. The insertion depth of the plug 220 may be a distance between the top of insertion groove and the end of plug 220 that is inserted into the insertion groove. In some embodiments, the depth of insertion groove can be the same as the insertion depth of plug 220. In some embodiments, the depth of insertion groove can be less than the insertion depth of plug 220.

Power strip system 120 may include a hot wire and a neutral wire. In some embodiments, the hot wire and the neutral wire may be positioned on the same side of the insertion groove. In some embodiments, the hot wire and the neutral wire may be positioned on different sides of the insertion groove. In some embodiments, one of the hot wire and the neutral wire may be positioned on a side of the insertion groove, and the other one may be positioned at the bottom of the insertion groove.

Power strip system 120 may include a hot wire, a ground wire and a neutral wire. In some embodiments, the hot wire, the ground wire and the neutral wire may be positioned on the same side of the insertion groove. In some embodiments, the hot wire, the ground wire and the neutral wire may be positioned on different sides of the insertion groove. For example, the hot wire and the neutral wire may be positioned on one side of insertion groove, and the ground wire may be positioned on the other side of the insertion groove. In some embodiments, the hot wire may be positioned on one side of the insertion groove, the neural wire may be positioned on the other side of the insertion groove, and ground wire may be positioned at the bottom of insertion groove.

It is to be understood that the positions of the hot wire, the ground wire and the neutral wire described above are intended to be presented by way of example only and are not limiting. Numerous other changes, substitutions, variations, alterations, and modifications may be ascertained to one skilled in the art after understanding the configuration rules of the hot wire, the ground wire and the neutral wire. It is intended that the present disclosure encompasses all such changes, substitutions, variations, alterations, and modifications as falling within the scope of the appended claims.

Figure 1B:
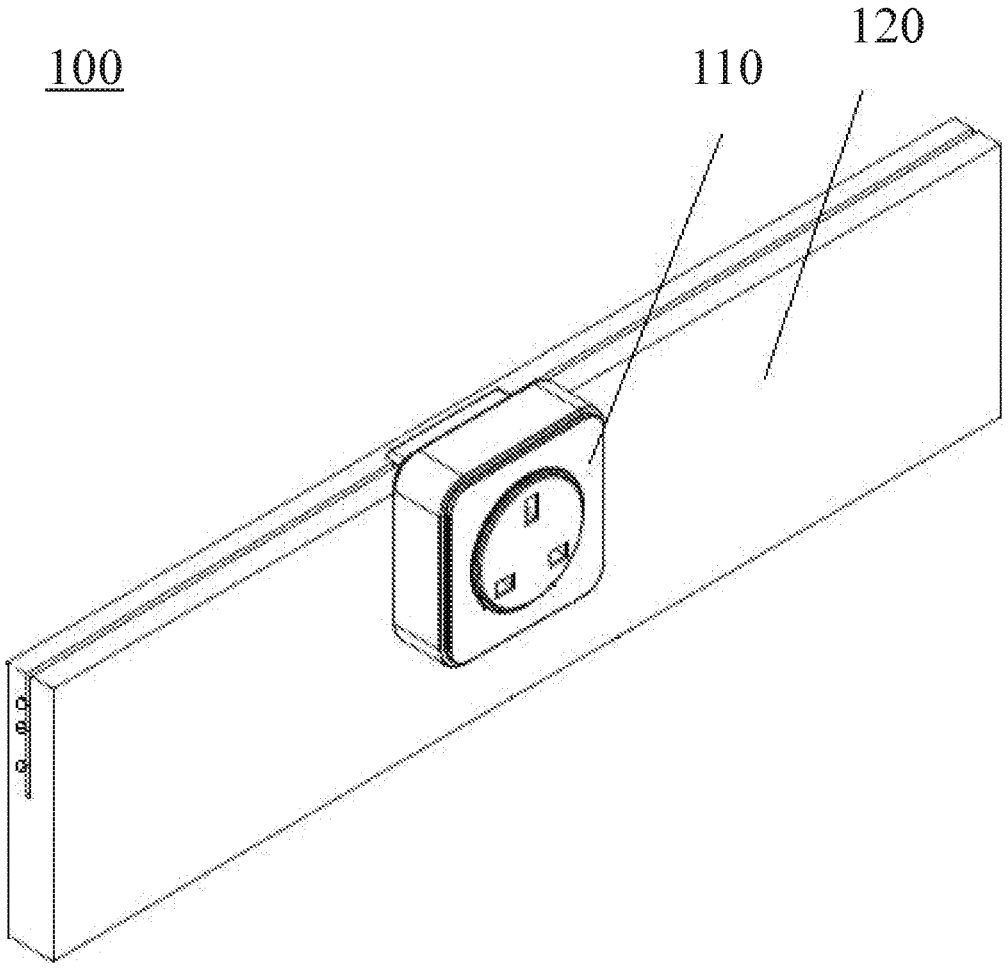
FIG. 1B illustrates an exemplary power outlet system in accordance with some embodiments of this disclosure.

FIG. 1B illustrates a perspective view of an exemplary socket module 110 connected to power strip system 120 in accordance with some embodiments of this disclosure. FIG. 1B illustrates a roughly squared socket module 110. In some embodiments, socket module 110 can be configured in any shape, such as, circular, triangular, quadrilateral, pentagon, hexagon, square, etc. In some embodiments, socket module 110 may include a socket core. In some embodiments, the socket core can be replaceable. The socket core can be configured in any shape, such as, circular, triangular, quadrilateral, pentagon, hexagon, etc. It is to be understood that FIG. 1B is intended to be presented by way of example only and are not limiting. In some embodiments, socket module 110 can be inserted into one or more fixed positions or non-fixed positions of the power outlet strip in the power strip system 120. Socket module 110 in the positions can connect to a power source and receive a power supply through the power strip system. Power strip system 120 may include any number of positons (e.g., one, two, three, four, etc.) to insert socket module 110. The positons may or may not be spaced evenly.

In some embodiments, socket module 110 cannot slide along the power outlet strip. Alternatively, socket module 110 can slide along the power outlet strip. In some embodiments, socket module 110 can always connect to a power source through the power outlet strip when sliding along the outlet strip. In some embodiments, socket module 110 can connect to a power source through the power outlet strip until it slides to a certain position. Socket module 110 may have any number of positions (e.g., one, two, three, four, etc.) to connect to a power source. The positons may or may not be spaced evenly.

In some embodiments, socket module 110 may include one or more indicators. Each of the indicators can include one or more indicator lights, such as one or more light-emitting diode (LED) lights or any other light that can be used to indicate one or more statuses of socket module 110. When socket module 110 is electrically connected to power strip system 120, one or more of the indicators may be activated to show that socket module 110 is energized. When socket module 110 is not connected or not well connected to power strip system 120, the indicator(s) in socket module 110 may not be activated to show that socket module 110 is not energized. In some embodiments, socket module 110 or power outlet strip may include an intelligent chip.

Figure 2:
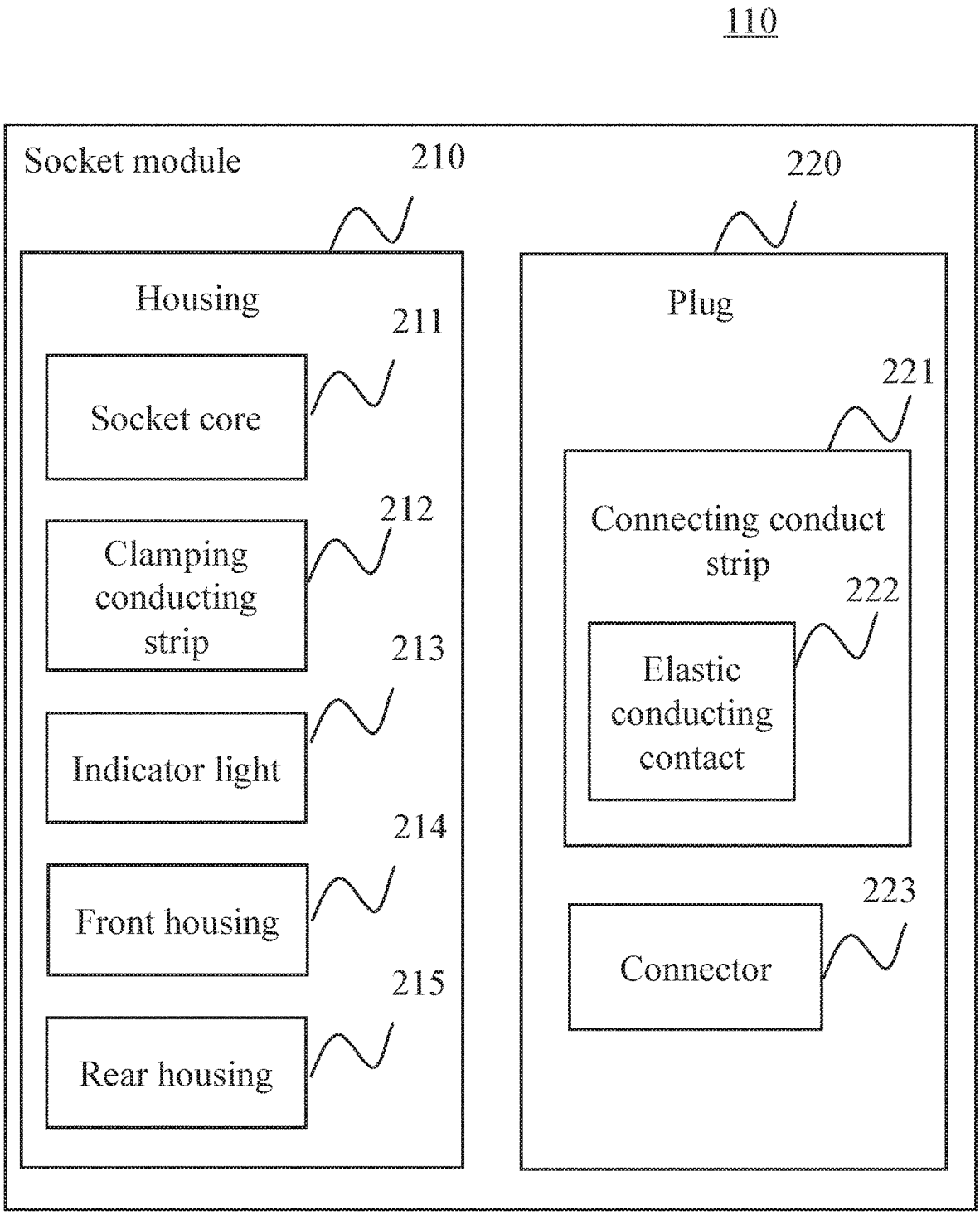
FIG. 2 illustrates an exemplary socket module in a power outlet system in accordance with some embodiments of this disclosure.

FIG. 2 illustrates an exemplary socket module 110 in a power outlet system 100 in accordance with some embodiments of this disclosure. Socket module 110 may include a housing 210 and a plug 220. In some embodiments, plug 220 and housing 210 may be separate. In some embodiments, one or more portions of plug 220 may be positioned in the housing 210.

Housing 210 may include a socket core 211, a clamping conducting strip 212, an indicator light 213, a front housing 214, and a rear housing 215. Socket core 211 may be positioned on at least one side of housing 210. The front housing 214 and/or the rear housing 215 may be manufactured using any suitable material, such as polyvinyl chloride (PVC), polyvinyl chloride (PC) which is also referred to as bullet proof rubber, polyamide 66 (PA66), a mixture of PA66 and 30% glass fiber and so on. Front housing 214 and rear housing 215 may or may not be made of the same material. The colors of front housing 214 and rear housing 215 may or may not be the same. Housing 210 may have any suitable dimension (e.g., thickness, length, width, etc.). In some embodiments, the thickness of housing 210 may be 1 mm to 100.0 mm. In some embodiments, the thickness of housing 210 may be 1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, 90.1 mm~100.0 mm, etc. In some embodiments, the thickness of hosing 210 may be 24 mm. The socket housing may be may be manufactured using any suitable material, such as PC 6555 of Bayer from Germany. When the experimental tensile speed is 50 mm/min, the yield stress may be 65 MPa, and the yield strain may be 6.0%. Clamping conducting strip 212 can be made of any conductive material, such as copper, brass, phosphor bronze, beryllium bronze, red copper, rose copper, copper alloy, copper cadmium alloy, copper nickel alloy, tin copper alloy, etc. The thickness of clamping conducting strip 212 may be 0.1 mm to 10.0 mm. In some embodiments, the thickness of clamping conducting strip 212 may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm or 9.1 mm~10.0 mm, etc. In some embodiments, the thickness of clamping conducting strip 212 may be 0.6 mm. The thickness of different clamping conducting strips 212 may or may not be the same.

The cross sectional area of clamping conducting strip 212 may be 0.1 $mm^2$ to 100.0 $mm^2$. In some embodiments, the cross sectional area of clamping conducting strip 212 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional areas of clamping conducting strip 212 may be greater than 2 $mm^2$. The cross sectional areas of different clamping conducting strips 212 may or may not be the same.

The clamp force of clamping conducting strip 212 for a single plug 220 of electrical appliances may be 0N to 100N. In some embodiments, The clamp force of clamping conducting strip 212 for a single plug 220 of electrical appliances may be 0.1N~1.0N, 1.1N~2.0N, 2.1N~3.0N, 3.1N~4.0N, 4.1N~5.0N, 5.1N~6.0N, 6.1N~7.0N, 7.1N~8.0N, 8.1N~9.0N, 9.1N~10.0N, 10.1N~20.0N, 20.1N~30.0N, 30.1N~40.0N, 40.1N~50.0N, 50.1N~60.0N, 60.1N~70.0N, 70.1N~80.0N, 80.1N~90.0N or 90.1N~100.0N, etc. In some embodiments, the clamp force of clamping conducting strip 212 for a single plug of electrical appliances may be greater than 7N and smaller than 15N. The clamp forces of different clamping conducting strips 212 for a single plug of electrical appliances may or may not be same.

Socket core 211 may include one or more slots and/or holes that match one or more power plugs. The slots and/or holes can conform with one or more national and/or international standards, such as the international standard of International Electrotechnical Commission (IEC), the British standards, the American standards, the European standards, the South African standards, the United Arab Emirates standards, the Korean standards, the Indian standards, the Russian standards, the Australian standards, or the like, or any combination thereof. In some embodiments, socket core 211 may include two or more slots and/or holes. In some embodiments, socket core 211 may include one or more USB ports. In some embodiments, socket core 211 may include a slot and a USB port. The slot(s) and the USB port(s) may be arranged in any manner. Socket core 211 can include any suitable number of slots and/or USB ports. The number and position may or may not be the same as those of slots of regular sockets.

In some embodiments, socket core 211 is not replaceable. Slots and/or holes of socket core 211 and front housing 214 of socket module 110 may form an integral part of the socket module. In some embodiments, socket core 211 is replaceable. For example, a socket core with two slots and/or holes can be replaced by a socket core with three slots and/or holes. Clamping conducting strip 212 may be positioned in the socket core 211. Clamping conducting strip 212 may be replaced when socket core 211 is replaced. In some embodiments, clamping conducting strip 212 and socket core 211 may be implemented as standalone parts. Clamping conducting strip 212 may remain in housing 210 when socket core 211 is replaced. In some embodiments, socket core 211 can be replaced by other electrical device, such as a router, a sensor, an alarm, a detector, a camera, a charger or a converter, or the like, or any combination thereof.

Clamping conducting strip 212 in socket module 110 may correspond to the slots and/or holes in socket core 211. For example, a plug of an electrical appliance may be connected to clamping conducting strip 212 when the plug's pins are inserted into socket module 110 through the slots and/or holes. Connecting conducting strip 221 of plug 220 may be connected to (e.g., electrically connected to) clamping conducting strip 212. Connecting conducting strip 221 can be made of any conductive material, such as copper, brass, phosphor bronze, beryllium bronze, red copper, rose copper, copper alloy, copper cadmium alloy, copper nickel alloy, tin copper alloy, etc. In some embodiments, connecting conducting strip 221 may be electrically connected to clamping conducting strip directly. In some embodiments, connecting conducting strip 221 may be electrically connected to clamping conducting strip 212 through a conductor (not shown in the figure). The conductor can be made of any conductive material, such as, copper, brass, phosphor bronze, beryllium bronze, red copper, rose copper, copper alloy, copper cadmium alloy, copper nickel alloy, tin copper alloy, etc.

Figure 3A:
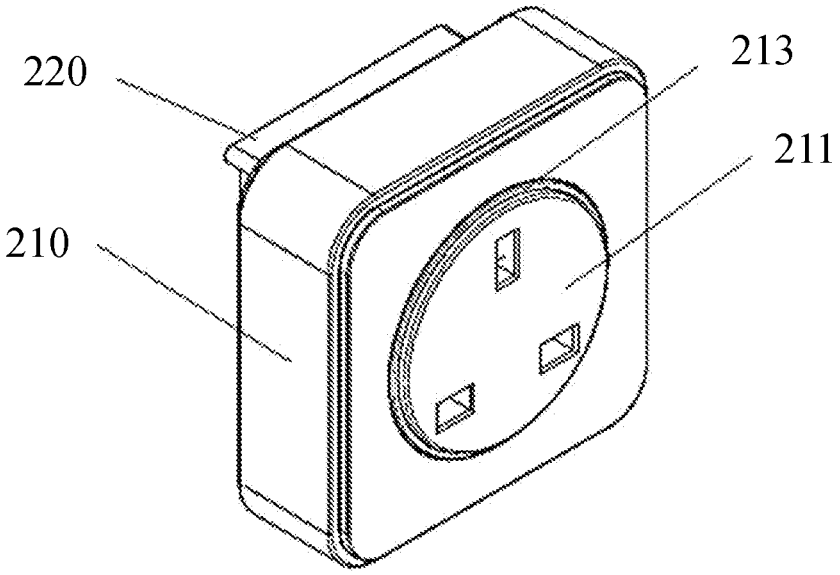
FIG. 3A illustrates a perspective view of an exemplary socket in accordance with some embodiments of this disclosure.

In some embodiments, socket module 110 may include one or more indicator lights 213. Socket module 110 can have any suitable number of indicator lights (e.g., one, two, three, four, etc.). Indicator lights 213 may be arranged and/or positioned in any manner. In some embodiments, the indicator light 213 may be positioned around socket core 211 (as shown in FIG. 3A). In some embodiments, the indicator light 213 may be positioned around housing 210. In some embodiments, the indicator light 213 may be positioned on front housing 214, such as the front side, the left side, the right side, the top side, the bottom side, the like, or any combination thereof. In some embodiments, the indicator light 213 may be positioned on one edge or one corner of front housing 214. Indicator lights 213 may be configured in any color, such as red, yellow, blue, green, purple, white, the like, or any combination thereof. Indicator lights 213 may be configured in any shape, such as circle, triangle, quadrangle, pentagon, hexagon, the like, or any combination thereof. In some embodiments, indicator light 213 may be activated when socket module 110 is connected to power outlet strip 120. In some embodiments, indicator light 213 may be activated for a certain time and then go off when socket module 110 is inserted into power outlet strip 120. Indicator light 213 may be activated for any time period (e.g., longer than an hour, an hour, less than an hour, etc.). In some embodiments, indicator light 213 may be activated for 1 second-59 seconds, 1 minutes~10 minutes, 11 minutes~20 minutes, 21 minutes~30 minutes, 31 minutes~40 minutes, 41 minutes~50 minutes, 51 minutes—60 minutes, etc. In some embodiments, indicator light 213 may flash at a particular frequency when socket module 110 is connected to power outlet strip 120. In some embodiments, indicator light 213 may flash for a certain time period and then stop flashing. In some embodiments, indicator light 213 may begin flashing after a certain time period.

Plug 220 may include a connecting conducting strip 221 and a connector 223. Connecting conducing strip 221 may be positioned on the surface of plug 220, in plug 220, or in any other suitable manner. One or more portions of plug 220 (e.g., a portion other than connecting conducting strip 221) may be made of any suitable insulation material, such as PVC, PC, PA 66, a mixture of PA66 and 30% glass fiber and so on. The front housing 214 and/and the rear housing 215 may be manufactured using any suitable material, such as PVC, PC, PA 66, a mixture of PA66 and 30% glass fiber and so on. One or more portions of plug 220 (e.g., a portion other than connecting conducting strips) may nor may not be made of same material with front housing 214 and/or rear housing 215. In some embodiments, one or more portions of plug 220 (e.g., a portion other than connecting conducting strip 221) may be made of a mixture of PA66 and 30% glass fiber. The front housing 214 and/or the rear housing 215 may be manufactured using any suitable material, such as PVC. Front housing 214 and rear housing 215 may or may not be configured in same color. Connecting conducting strip 212 can be made of any conductive material, such as copper, brass, phosphor bronze, beryllium bronze, red copper, rose copper, copper alloy, copper cadmium alloy, copper nickel alloy, tin copper alloy, etc. Plug 220 may be bended in any degree, such as ±1°, ±2°, ±3°, ±4°, ±5° and so on. Plug 220 may be twisted in any degree, such as, ±1°, ±2°, ±3°, ±4°, ±5° and so on. The cross sectional area of connecting conducting strip 221 may be 0.1 $mm^2$ to 100.0 $mm^2$. In some embodiments, the cross sectional area of Connecting conducting strip 221 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional area of connecting conducting strip 221 may be 2.6 $mm^2$. The cross sectional areas of different connecting conducting strips 212 may or may not be the same.

In some embodiments, connecting conducting strip 221 may include one or more elastic conducting contacts 222. Plug 220 may connect to power outlet strip through elastic conducting contact 222 so that socket module 110 may conduct electricity. Elastic conducting contact 222 may be arranged and/or positioned to correspond to the position of conductor in the power outlet strip. In some embodiments, connecting conducting strip 221 may include multiple elastic conducting contacts 222. For example, connecting conducting strip 221 may include two elastic conducting contacts 222. The elastic conducting contacts may be connected to a hot wire and a neutral wire, respectively. The two elastic conducting contacts 222 may or may or be positioned on the same side of plug 220. Elastic conducting contacts 222 on the same side of plug 220 may be placed at different positions (e.g., different heights). In some embodiments, the distance between a hot wire and plug 220 inserted into power strip system 120 may be shorter than that a neutral wire and the plug 220. In some embodiments, one of the two elastic conducting contacts 222 may be positioned at the bottom of plug 120. As another example, connecting conducting strip 221 may include three elastic conducting contacts 222. The elastic conducting contacts 222 may connect to a hot wire, a neutral wire, and a ground wire, respectively. The three elastic conducting contacts 222 may or may not be positioned on the same side of plug 220. In some embodiments, one of the elastic conducting contacts may be positioned at the bottom of the plug 220. The other contacts may or may not be positioned at the bottom of the plug 220. As another example, connecting conducting strip 221 may include six elastic conducting contacts 222. Three of the elastic conducting contacts may be positioned on the same side of the plug 220, and the other contacts may be positioned on another side of the plug 220. In some embodiments, at least one of the elastic conducting contacts may be positioned at the bottom of the plug 220. In some embodiments, the two sides of plug 220 may be functionally equivalent. For example, socket module 110 will conduct electricity when any side of the plug 220 is inserted into power strip system 120 installed on the wall. In some embodiments, the two sides of plug 220 may not be functionally equivalent. For example, socket module 110 will conduct electricity only when a certain side of plug 220 is inserted into power strip system 120 installed on the wall.

The density of plug 220 may be 0.1 g/cm$^3$ and 100.0 g/cm$^3$. In some embodiments, the density of plug 220 may be 0.1 g/cm$^3$~1.0 g/cm$^3$, 1.1 g/cm$^3$~2.0 g/cm$^3$, 2.1 g/cm$^3$~3.0 g/cm$^3$, 3.1 g/cm$^3$~4.0 g/cm$^3$, 4.1 g/cm$^3$~5.0 g/cm$^3$, 5.1 g/cm$^3$~6.0 g/cm$^3$, 6.1 g/cm$^3$~7.0 g/cm$^3$, 7.1 g/cm$^3$~8.0 g/cm$^3$, 8.1 g/cm$^3$~9.0 g/cm$^3$, 9.1 g/cm$^3$~10.0 g/cm$^3$, 10.1 g/cm$^3$~20.0 g/cm$^3$, 20.1 g/cm$^3$~30.0 g/cm$^3$, 30.1 g/cm$^3$~40.0 g/cm$^3$, 40.1 g/cm$^3$~50.0 g/cm$^3$, 50.1 g/cm$^3$~60.0 g/cm$^3$, 60.1 g/cm$^3$~70.0 g/cm$^3$, 70.1 g/cm$^3$~80.0 g/cm$^3$, 80.1 g/cm$^3$~90.0 g/cm$^3$, or 90.1 g/cm$^3$~100.0 g/cm$^3$, etc. In some embodiments, the density of plug 220 may be 1.48 g/cm$^3$. The densities of different plugs 220 may or may not be the same.

The tensile strength of plug 220 may be 100.1 MPa~200.0 MPa. In some embodiments, the tensile strength of plug 220 may be 100.1 MPa~101 MPa, 101.1 MPa~102.0 MPa, 102.1 MPa~103.0 MPa, 103.1 MPa~104.0 MPa, 104.1 MPa~105.0 MPa, 105.1 MPa~106.0 MPa, 106.1 MPa~107.0 MPa, 107.1 MPa~108.0 MPa, 108.1 MPa~109.0 MPa, 109.1 MPa~110.0 MPa, 110.1 MPa~120.0 MPa, 120.1 MPa~130.0 MPa, 130.1 MPa~140.0 MPa, 140.1 MPa~150.0 MPa, 150.1 MPa~160.0 MPa, 160.1 MPa~170.0 MPa, 170.1 MPa~180.0 MPa, 180.1 MPa~190.0 MPa, or 190.1 MPa~200.0 MPa, etc. In some embodiments, the tensile strength of plug 220 may be 145 MPa. The tensile strengths of different plugs 220 may or may not be the same.

The elongation at break of plug 220 may be 1%~100%. In some embodiments, the elongation at break of plug 220 may be 0.1%~1.0%, 1.1%~2.0%, 2.1%~3.0%, 3.1%~4.0%, 4.1%~5.0%, 5.1%~6.0%, 6.1%~7.0%, 7.1%~8.0%, 8.1%~9.0%, 9.1%~10.0%, 10.1%~20.0%, 20.1%~30.0%, 30.1%~40.0%, 40.1%~50.0%, 50.1%~60.0%, 60.1%~70.0%, 70.1%~80.0%, 80.1%~90.0%, or 90.1%~100.0%, etc. In some embodiments, the elongation at break of plug 220 may be 2%. The elongations at break of different plugs 220 may or may not be the same.

The bending strength of plug 220 may be 150.1 MPa~250.0 MPa. In some embodiments, the bending strength of plug 220 may be 150.1 MPa~151 MPa, 151.1 MPa~152.0 MPa, 152.1 MPa~153.0 MPa, 153.1 MPa~154.0 MPa, 154.1 MPa~155.0 MPa, 155.1 MPa~156.0 MPa, 156.1 MPa~157.0 MPa, 157.1 MPa~158.0 MPa, 158.1 MPa~159.0 MPa, 159.1 MPa~160.0 MPa, 160.1 MPa~170.0 MPa, 170.1 MPa~180.0 MPa, 180.1 MPa~190.0 MPa, 190.1 MPa~200.0 MPa, 200.1 MPa~210.0 MPa, 210.1 MPa~220.0 MPa, 220.1 MPa~230.0 MPa, 230.1 MPa~240.0 MPa, or240.1 MPa~250.0 MPa, etc. In some embodiments, the bending strength of plug 220 may be 200 MPa. The bending strengths of different plugs 220 may or may not be the same.

The IZOD notched impact strength of plug 220 may be 0.1 kJ/m$^2$~100.0 kJ/m$^2$. In some embodiments, the IZOD notched impact strength of plug 220 may be 0.1 kJ/m$^2$~1.0 kJ/m$^2$, 1.1 kJ/m$^2$~2.0 kJ/m$^2$, 2.1 kJ/m$^2$~3.0 kJ/m$^2$, 3.1 kJ/m$^2$~4.0 kJ/m$^2$, 4.1 kJ/m$^2$~5.0 kJ/m$^2$, 5.1 kJ/m$^2$~6.0 kJ/m$^2$, 6.1 kJ/m$^2$~7.0 kJ/m$^2$, 7.1 kJ/m$^2$~8.0 kJ/m$^2$, 8.1 kJ/m$^2$~9.0 kJ/m$^2$, 9.1 kJ/m$^2$~10.0 kJ/m$^2$, 10.1 kJ/m$^2$~20.0 kJ/m$^2$, 20.1 kJ/m$^2$~30.0 kJ/m$^2$, 30.1 kJ/m$^2$~40.0 kJ/m$^2$, 40.1 kJ/m$^2$~50.0 kJ/m$^2$, 50.1 kJ/m$^2$~60.0 kJ/m$^2$, 60.1 kJ/m$^2$~70.0 kJ/m$^2$, 70.1 kJ/m$^2$~80.0 kJ/m$^2$, 80.1 kJ/m$^2$~90.0 kJ/m$^2$, or 90.1 kJ/m$^2$~100.0 kJ/m$^2$, etc. In some embodiments, the IZOD notched impact strength of plug 220 may be 12 kJ/m$^2$. The IZOD notched impact strengths of different plugs 220 may or may not be the same r.

The Rockwell hardness of plug 220 may be 100.1~200.0. In some embodiments, the Rockwell hardness of plug 220 may be 100.1~101, 101.1~102.0, 102.1~103.0, 103.1~104.0, 104.1~105.0, 105.1~106.0, 106.1~107.0, 107.1~108.0, 108.1~109.0, 109.1~110.0, 110.1~120.0, 120.1~130.0, 130.1~140.0, 140.1~150.0, 150.1~160.0, 160.1~170.0, 170.1~180.0, 180.1~190.0, or 190.1~200.0, etc. In some embodiments, the Rockwell hardness of plug 220 may be 120. The Rockwell harnesses of different plugs 220 may or may not be the same.

The melting point of plug 220 may be 250.1° C.~350.0° C. In some embodiments, the melting point of plug 220 may be 250.1° C.~251° C., 251.1° C. 252.0° C., 252.1° C.~253.0° C., 253.1° C.~254.0° C., 254.1° C.~255.0° C., 255.1° C.~256.0° C., 256.1° C.~257.0° C., 257.1° C.~258.0° C., 258.1° C.~259.0° C., 259.1° C.~260.0° C., 260.1° C. 270.0° C., 270.1° C.~280.0° C., 280.1° C.~290.0° C., 290.1° C.~300.0° C., 300.1° C.~310.0° C., 310.1° C.~320.0° C., 320.1° C.~330.0° C., 330.1° C.~340.0° C., or 340.1° C.~350.0° C., etc. In some embodiments, the melting point of plug 220 may be 255° C. The melting points of different plugs 220 may or may not be the same.

The heat distortion temperature of plug 220 may be 200.1° C.~300.0° C. In some embodiments, the thermal deformation temperature of plug 220 may be 200.1° C.~201° C., 201.1° C.~202.0° C., 202.1° C.~203.0° C., 203.1° C.~204.0° C., 204.1° C. 205.0° C., 205.1° C.~206.0° C., 206.1° C.~207.0° C., 207.1° C.~208.0° C., 208.1° C.~209.0° C., 209.1° C.~210.0° C., 210.1° C.~220.0° C., 220.1° C.~230.0° C., 230.1° C.~240.0° C., 240.1° C. 250.0° C., 250.1° C.~260.0° C., 260.1° C.~270.0° C., 270.1° C.~280.0° C., 280.1° C.~290.0° C., or 290.1° C.~300.0° C., etc. In some embodiments, the heat distortion temperature of plug 220 may be 250° C. The heat distortion temperatures of different plugs 220 may or may not be the same. In some embodiments, the flame resistance of plug 220 according to UL-94 standard is V0, V1 or V2. The flame resistance of plug 220 may preferentially be V0.

The surface resistivity of plug 220 may be 1000Ω~1100Ω. In some embodiments, the surface resistivity of plug 220 may be 1000.1Ω~1001Ω, 1001.1Ω~1002.0Ω, 1002.1Ω~1003.0Ω, 1003.1Ω~1004.0Ω, 1004.1Ω~1005.0Ω, 1005.1Ω~1006.0Ω, 1006.1Ω~1007.0Ω, 1007.1Ω~1008.0Ω, 1008.1Ω~1009.0Ω, 1009.1Ω~1010.0Ω, 1010.1Ω~1020.0Ω, 1020.1Ω~1030.0Ω, 1030.1Ω~1040.0Ω, 1040.1Ω~1050.0Ω, 1050.1Ω~1060.0Ω, 1060.1 Ω ~1070.0Ω, 1070.1 Ω ~1080.0Ω, 1080.1 Ω ~1090.0Ω, or 1090.1 Ω ~1100.0Ω, etc. In some embodiments, the surface resistivity of plug 220 may be 1014Ω. The surface resistivity of different plugs 220 may or may not be the same.

The molding shrinkage of plug 220 may be 1%~100%. In some embodiments, the molding shrinkage of plug 220 may be 0.1%~1.0%, 1.1%~2.0%, 2.1%~3.0%, 3.1%~4.0%, 4.1%~5.0%, 5.1%~6.0%, 6.1%~7.0%, 7.1%~8.0%, 8.1%~9.0%, 9.1%~10.0%, 10.1%~20.0%, 20.1%~30.0%, 30.1%~40.0%, 40.1%~50.0%, 50.1%~60.0%, 60.1%~70.0%, 70.1%~80.0%, 80.1%~90.0%, or 90.1%~100.0%, etc. In some embodiments, the molding shrinkage of plug 220 may be 0.2%~0.6%. The molding shrinkage of different plugs 220 may or may not be the same.

The saturated sorptivity of plug 220 may be 1%~100%. In some embodiments, the saturated sorptivity of plug 220 may be 0.1%~1.0%, 1.1%~2.0%, 2.1%~3.0%, 3.1%~4.0%, 4.1%~5.0%, 5.1%~6.0%, 6.1%~7.0%, 7.1%~8.0%, 8.1%~9.0%, 9.1%~10.0%, 10.1%~20.0%, 20.1%~30.0%, 30.1%~40.0%, 40.1%~50.0%, 50.1%~60.0%, 60.1%~70.0%, 70.1%~80.0%, 80.1%~90.0%, or 90.1%~100.0%, etc. In some embodiments, the saturated sorptivity of plug 220 may be 6%. The saturated sorptivity of different plugs 220 may or may not be the same.

The force required to insert the plug 220 into power outlet strip or to pull the plug 220 out from power outlet strip may be 0-100N. In some embodiments, the force to insert the plug 220 into power outlet strip or to pull the plug 220 out from power outlet strip may be 0.1N~1.0N, 1.1N~2.0N, 2.1N~3.0N, 3.1N~4.0N, 4.1N~5.0N, 5.1N~6.0N, 6.1N~7.0N, 7.1N~8.0N, 8.1N~9.0N, 9.1N~10.0N, 10.1N~20.0N, 20.1N~30.0N, 30.1N~40.0N, 40.1N~50.0N, 50.1N~60.0N, 60.1N~70.0N, 70.1N~80.0N, 80.1N~90.0N, or 90.1N~100.0N, etc. In some embodiments, the force required to insert the plug 220 into power outlet strip or to pull the plug 220 out from electrical power outlet strip may be 52N. In some embodiments, the force required to insert the plug 220 into power outlet strip or to pull the plug 220 out from power outlet strip may be greater than 27N and smaller than 64N. The forces to insert different plugs 222 into power outlet strip or the forces to pull different plugs 222 from power outlet strip may or may not be the same.

Figure 8A:
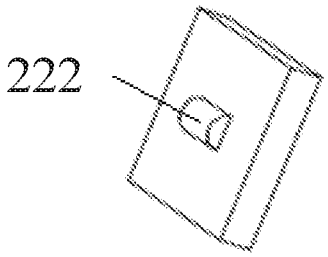
FIG. 8A illustrates an exemplary elastic conduct contact point with a curved surface in accordance with some embodiments of this disclosure.
Figure 8B:
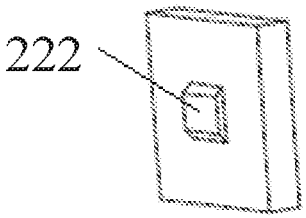
FIG. 8B illustrates an exemplary elastic conduct contact point with a stepped surface in accordance with some embodiments of this disclosure.

Elastic conducting contact 222 may have any type of surface. For example, elastic conducting contact 222 may have a curved surface in some embodiments (e.g., a surface as shown in FIG. 8A). As another example, elastic conducting contact 222 may have a stepped surface (e.g., a surface as shown in FIG. 8B).

The cross sectional area of elastic conducting contact 222 may be 0.1 $mm^2$ to 100.0 $mm^2$. In some embodiments, the cross sectional area of elastic conducting contact 222 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional areas of elastic conducting contact 222 may be 2 $mm^2$. The cross sectional areas of different elastic conducting contacts 222 may or may not be the same.

The maximum current that elastic conducting contact 222 can safely withstand may be 0-100 A. In some embodiments, the maximum current that elastic conducting contact 222 can safely withstand may be 0.1 A~1.0 A, 1.1 A~2.0 A, 2.1 A~3.0 A, 3.1 A~4.0 A, 4.1 A~5.0 A, 5.1 A~6.0 A, 6.1 A~7.0 A, 7.1 A~8.0 A, 8.1 A~9.0 A, 9.1 A~10.0 A, 10.1 A~20.0 A, 20.1 A~30.0 A, 30.1 A~40.0 A, 40.1 A~50.0 A, 50.1 A~60.0 A, 60.1 A~70.0 A, 70.1 A~80.0 A, 80.1 A~90.0 A, or 90.1 A~100.0 A, etc. In some embodiments, maximum current that elastic conducting contact 222 can safely withstand may be 16 A. The maximum currents that different elastic conducting contacts 222 can safely withstand may or may not be the same.

The maximum voltage that elastic conducting contact 222 can safely withstand may be 0-10000V. In some embodiments, the maximum voltage that elastic conducting contact 222 can safely withstand may be 10V~100V, 110V~200V, 210V~300V, 310V~400V, 410V~500V, 510V~600V, 610V~700V, 710V~800V, 810V~900V, 910V~1000V, 1010V~2000V, 2010V~3000V, 3010V~4000V, 4010V~5000V, 5010V~6000V, 6010V~7000V, 7010V~8000V, 8010V~9000V, or 9010V~1000V, etc. In some embodiments, maximum voltage that elastic conducting contact 222 can safely withstand may be 3500V. The maximum voltages that different elastic conducting contacts 222 can safely withstand may or may not be the same.

The height of elastic conducting contact 222 exposed on plug 220 may be 0.1 mm~10.0 mm. In some embodiments, the height of elastic conducting contact 222 exposed on plug 220 may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, or 9.1 mm~10.0 mm, etc. In some embodiments, the height of elastic conducting contact 222 exposed on plug 220 may be 0.6 mm. The height of different elastic conducting contacts 222 exposed on plug 220 may or may not be the same.

In some embodiments, connector 223 may establish a connection between plug 220 and housing 210. In some embodiments, plug 220 and housing 210 may form an integral and/or inseparable part. In some embodiments, plug 220 and housing 210 may be separable. In some embodiments, connecting conducting strip 221 of plug 220 may be connected to (e.g., electrically connected to) clamping conducting strip of housing 210 when plug 220 is connected to (e.g., electrically connected to) housing 210. In some embodiments, as will be discussed in more detail in connection with FIGS. 7A to 7E, housing 210 may include a spring.

It is to be noted that the descriptions above in relation to the socket module 110 are intended to be present by way of example and are not limiting. It can be understood that numerous other changes, substitutions, variations, alterations, and modifications may be ascertained to one skilled in the art after understanding the structure of socket module. For example, in some embodiments, indicator light 213 may be positioned on the plug 220. In some embodiments, socket module may include some other components. It is intended that the present disclosure encompasses all such changes, substitutions, variations, alterations, and modifications as falling within the scope of the appended claims.

Figure 3B:
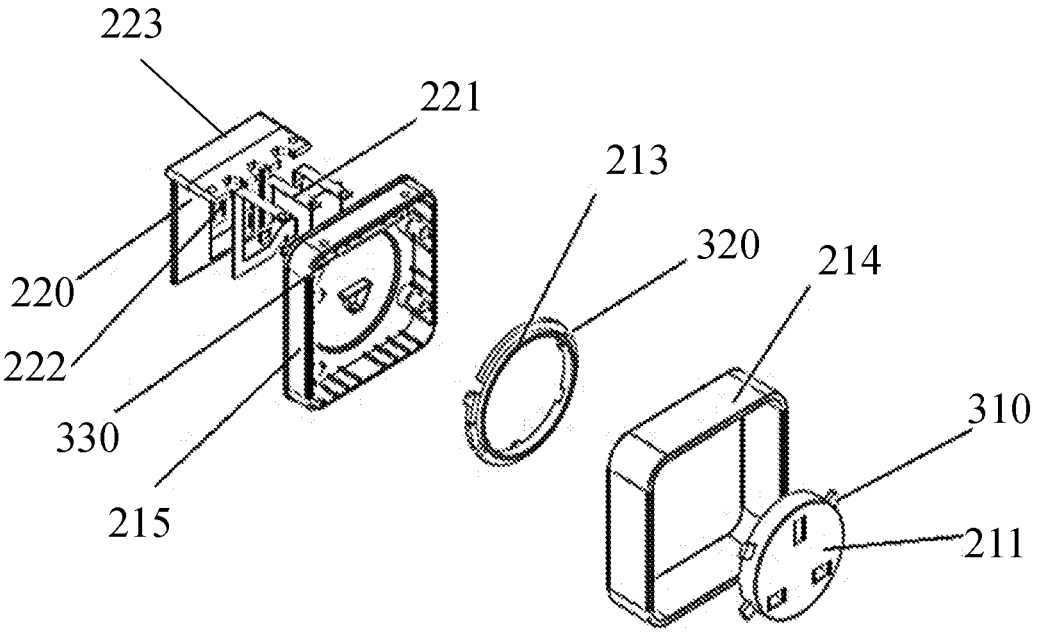
FIG. 3B illustrates a partial exploded view of an exemplary socket in accordance with some embodiments of this disclosure.

FIGS. 3A and 3B illustrate an exemplary socket module in accordance with some embodiments of this disclosure. FIG. 3A illustrates a perspective view of the exemplary socket. FIG. 3B illustrates a partial exploded view of the exemplary socket. Socket module 110 may include a housing 210 and a plug 220. The shape of housing 210 in FIGS. 3A and 3B is intended to be presented by way of example only, the present application is not limited to the embodiments as shown and described. Housing 210 may include a front housing 214 and a rear housing 215. Front housing 214 may include a circular socket core 211 on its front side configured to connect to plug 220. In some embodiments, socket core 211 may not be replaceable. In some embodiments, socket core 211 may be replaceable. For example, the circular socket core 211 shown in FIGS. 3A and 3B may be replaced by a socket core with multiple slots and/or holes (e.g., two slots and/or holes, three slots and/or holes, etc.). The slots and/or holes can conform with one or more national and/or international standards, such as international standard of International Electrotechnical Commission (IEC), the British standards, the American standards, the European standards, the South African standards, the United Arab Emirates standards, the Korean standards, the Indian standards, the Russian standards, the Australian standards, or the like, or any combination thereof. Socket core 211 may include a clamping conducting strip 212. In some embodiments, the front side of socket core 211 may be even with the front side of front housing. In some embodiments, the front side of socket core 211 may be protruded from the front side of front housing or may be dented into the front side of front housing.

One or more blocks 310 may be positioned around socket core 211. One or more slots 320 may be positioned around indicator light 213. Socket core 211 may be inserted into slot 320 though block 310 to be connected to (e.g., electrically connected to) indicator light 213. In some embodiments, indicator light 213 may be positioned on the indicator light holder. Slot 320 may be positioned on the indicator light holder. The connection achieved by slot and block is intended to be presented by way of example only, the present application is not limited to the embodiments as shown and described. Socket module 110 may include any suitable number of blocks 310. The number of block 310 may be an odd number or an even number. Block 310 may be arranged in any suitable manner. Block 310 may be arranged in a symmetrical configuration or an asymmetric configuration. Block 310 may be formed in regular shape or irregular shape. The regular shape may include cuboid, sphere, prism, prism, cylinder, cone, etc. The number, arrangement and shape of slot 320 may correspond to those of block 310.

Housing 210 may include an indicator light 213. Indicator light 213 may include a conductor. In some embodiments, indicator light 213 may be connected to connecting conducting strip 221 through the conductor. When plug 220 is connected to the power outlet strip, connecting conducting strip will connect to clamping conducting strip and indicator light 213 may be activated. Indicator light 213 may be circular as shown in FIGS. 3A and 3B. In some embodiments, indicator light 213 may be configured in any shape, such as, triangle, quadrangle, pentagon, hexagon or any other regular shape, or any other irregular shape. Housing 210 may include any suitable number of indicator lights 213 (e.g., one, two, three, four, etc.). Indicator light 213 may be arranged in any suitable manner. In some embodiments, indicator light 213 may be positioned on the front side, the left side, the right side, the top side, the bottom of housing, the like, or any combination thereof. Indicator light 213 may be configured in any color, such as, red, yellow, blue, green, purple, white, the like, or any combination thereof. In some embodiments, indicator light 213 may be always activated when socket module 110 is connected to (e.g., electrically connected to) power outlet strip. In some embodiments, indicator light 213 may be activated for a certain time period and then go off when socket module 110 is connected to (e.g., electrically connected to) power outlet strip. Indicator light 213 may be activated for any time period (e.g., longer than an hour, an hour, less than an hour, etc.). In some embodiments, indicator light 213 may be activated for 1 second~59 seconds, 1 minutes~10 minutes, 11 minutes~20 minutes, 21 minutes~30 minutes, 31 minutes 40 minutes, 41 minutes~50 minutes, 51 minutes~60 minutes and so on. In some embodiments, indicator light 213 may flash at a particular frequency when socket module 110 is connected to (e.g., electrically connected to) power outlet strip 120. In some embodiments, indicator light 213 may flash for a certain time period and then stop flashing. In some embodiments, indicator light 213 may begin flashing after a certain time period.

Housing 210 may include a hanging groove 330. Hanging groove 330 may be configured to fix front housing 214 and rear housing 215. Housing 210 can have any suitable number of hanging grooves (e.g., one, two, three, four, etc.). The number of hanging groove 330 may be an odd number or an even number. Hanging groove 330 may be arranged in any suitable manner. Hanging groove 330 may be arranged in a symmetrical configuration or an asymmetric configuration. Plug 220 may be positioned on the back of the rear housing 215. Connector 233 of plug 220 may be inserted into housing 210 though hanging groove 330. Connecting conducting strip 221 may be positioned in plug 220. Connecting conducting strip 221 may form an elastic conducting contact 222 on the surface of plug 220. Elastic conducting contact 222 may be configured to be connected to power outlet strip.

Figure 4A:
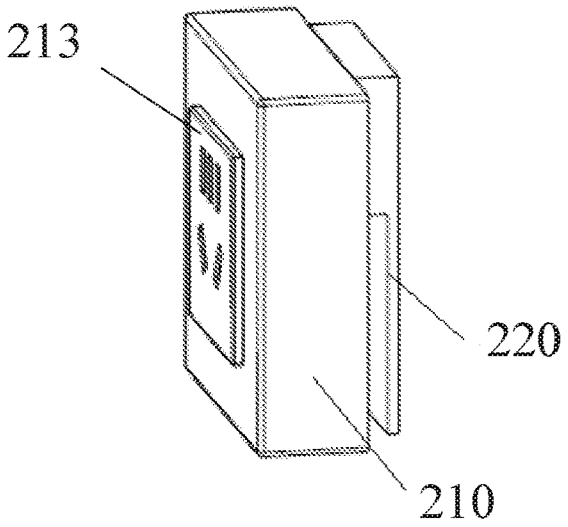
FIG. 4A illustrates a perspective view of an exemplary socket in accordance with some embodiments of this disclosure.
Figure 4B:
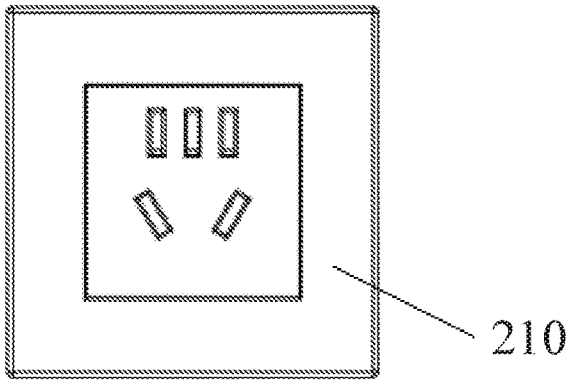
FIG. 4B illustrates a front view of an exemplary socket in accordance with some embodiments of this disclosure.
Figure 4C:
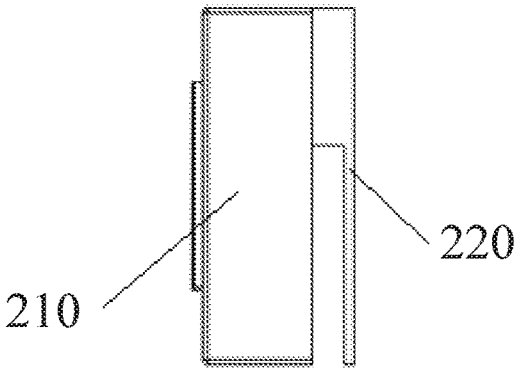
FIG. 4C illustrates a side view of an exemplary socket in accordance with some embodiments of this disclosure.

Plug 220 shown in FIG. 3B may include a connector 223 and a vertical part. The distance between the vertical part of connector 223 and the front end or the rear end of housing 210, namely the length of connector 223 is denoted as din the following description for convenience. The distance between the vertical part of plug 220 and left end or right end of housing 210 may be denoted as the width of connector 223. The distance between the vertical part of plug 220 and left end or right end of housing 210 may be denoted as the width of the vertical part. In some embodiments, the vertical part of insert plug 220 may be even with the end of connector 223 which is away from housing 210 (as shown in FIGS. 4A to 4C). In some embodiments, there may be a distance between the vertical part of insert plug 220 and the end of connector 223 which is away from housing 210 (as shown in FIGS. 3A and 3B). The distance may be any distance less than d, such as, d/10, 2d/10, 3d/10, 4d/10, 5d/10, 6d/10, 7d/10, 8d/10, 9d/10, etc. In some embodiments, the width of connector 223 may or may not be the same as the width of the vertical part. The relevant height of connector 233 to the vertical part may variable. In some embodiments, connector 223 may be positioned above the vertical part (as shown in FIGS. 3A and 3B). In some embodiments, connector 223 may be positioned below the vertical part (as shown in FIGS. 7A to 7E). In some embodiments, connector 223 may be arranged parallel to the vertical part.

In some embodiments, plug 220 and the vertical part may form an inseparable part. In some embodiments, plug 220 and the vertical part may be implemented as standalone parts. In some embodiments, the angle between connector 223 and the vertical part may be any angle between 0 degree and 180 degrees, such as 0 degree~30 degrees, 30 degrees~60 degrees, 60 degrees~90 degrees, 90 degrees~120 degrees, 120 degrees~150 degrees, 150 degrees~180 degrees, etc. In some embodiments, connector 233 and the vertical part may be perpendicular with each other. In some embodiments, the angle between connector 233 and the vertical part may be fixed. In some embodiments, the angle between connector 233 and the vertical part may be variable. In some embodiments, the angle between connector 233 of plug 220 and housing 210 may be fixed. In some embodiments, the angle between connector 233 of plug 220 and housing 210 may be variable.

Figure 3C:
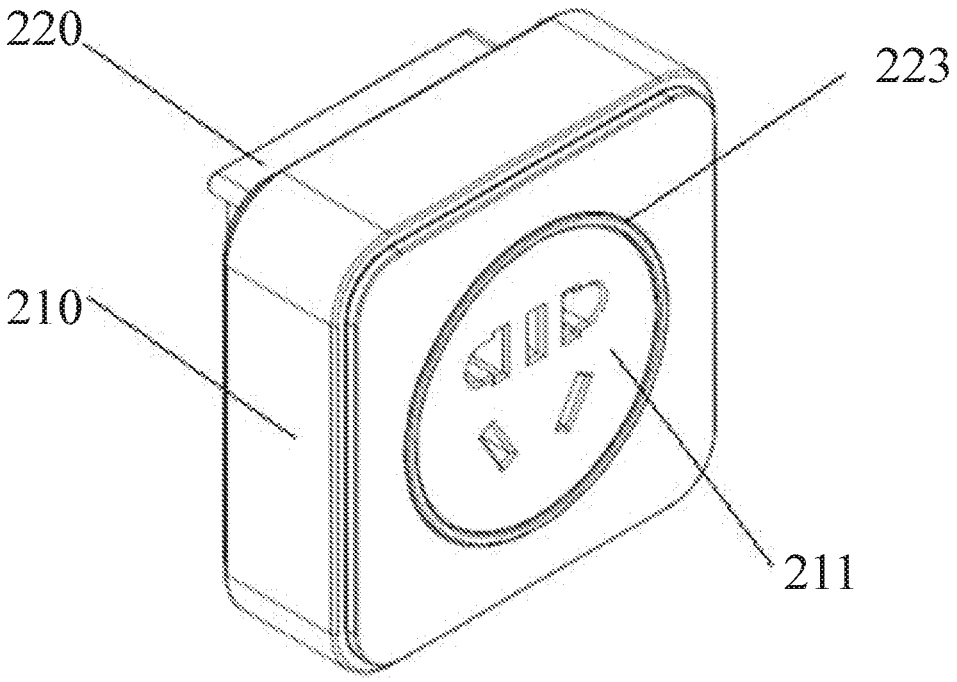
FIG. 3C illustrates a perspective view of an exemplary socket in accordance with some embodiments of this disclosure.

It should be noted that the structures describe above in relation to socket module 110 are intended to be presented by way of example only and the disclosure will not be limited to the said embodiments. It is understood that numerous other changes, substitutions, variations, alterations, and modifications of socket module 110 may be ascertained to one skilled in the art after understanding the structure of socket module 110. For example, in some embodiments, housing 210 and/or socket core 211 may be configured in any shape, including regular shape or irregular shape. The regular shape may include circular, triangular, quadrilateral, pentagon, hexagon, etc. In some embodiments, socket core 211 may be replaceable. As shown in FIGS. 3A and 3B, socket core 211 may include three slots and/or holes. As shown in FIG. 3C, socket core 211 may include five slots and/or holes. In some embodiments, socket core 211 can be replaced by other electrical device, such as a router, a sensor, an alarm, a detector, a camera, a charger or a converter, etc. It is intended that the present disclosure encompasses all such changes, substitutions, variations, alterations, and modifications as falling within the scope of the appended claims. The internal structure of the socket module in FIG. 3C is similar to that of the socket module in FIGS. 3A and 3B, which will not be described here.

FIGS. 4A to 4C illustrate an exemplary socket module including a quadrate socket core and a quadrate housing. FIG. 4A illustrates a perspective view of the exemplary socket. FIG. 4B illustrates a front view of the exemplary socket module. FIG. 4C illustrates a side view of the exemplary socket. As shown in FIGS. 4A and 4C, the front side of socket core 213 may be protruded from the front side of front housing. It should be noted that the disclosure may not be limited to the embodiments as enumerated above. In some embodiments, the front side of socket core 211 may be even with the front side of front housing or may be dented into the front side of front housing. The shape of housing 210 and socket core 213 may be presented by way of example, and the disclosure may not be limited to the embodiments as enumerated above. In some embodiments, housing 210 does not include an indicator light. In some embodiments, housing 210 may include an indicator light. The related descriptions about indicator light may be similar to descriptions in other parts of the disclosure, and may not be described here. In some embodiments, socket core 211 and housing 210 may form an integral part. In some embodiments socket core 211 may be replaceable. For example, a socket core with two slots and/or holes can be replaced by a socket core with three slots and/or holes. In some embodiments, socket core 211 can be replaced by other electrical device, such as a router, a sensor, an alarm, a detector, a camera, a charger or a converter, or the like. Such changes, substitutions, variations, alterations, and modifications as falling within the scope of the appended claims. Plug 220 and housing 210 may be connected by the way shown in FIGS. 6A to 6E, or by the way shown in FIGS. 7A to 7E.

Figure 5:
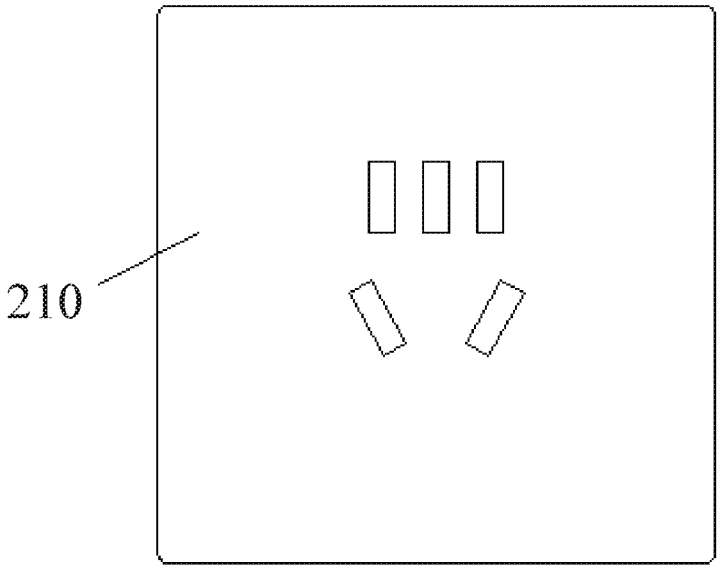
FIG. 5 illustrates a front view of an exemplary socket in accordance with some embodiments of this disclosure.

FIG. 5 illustrates a front view of an exemplary socket module with a quadrate housing. As shown in FIG. 5, one or more slots and/or holes may be positioned on the housing 210. In some embodiments, the socket module does not include a replaceable socket core. The socket module may or may not include an indicator light. The descriptions about socket module including an indicator light may be similar to descriptions in other parts of the disclosure, and may not be described here.

Figure 6A:
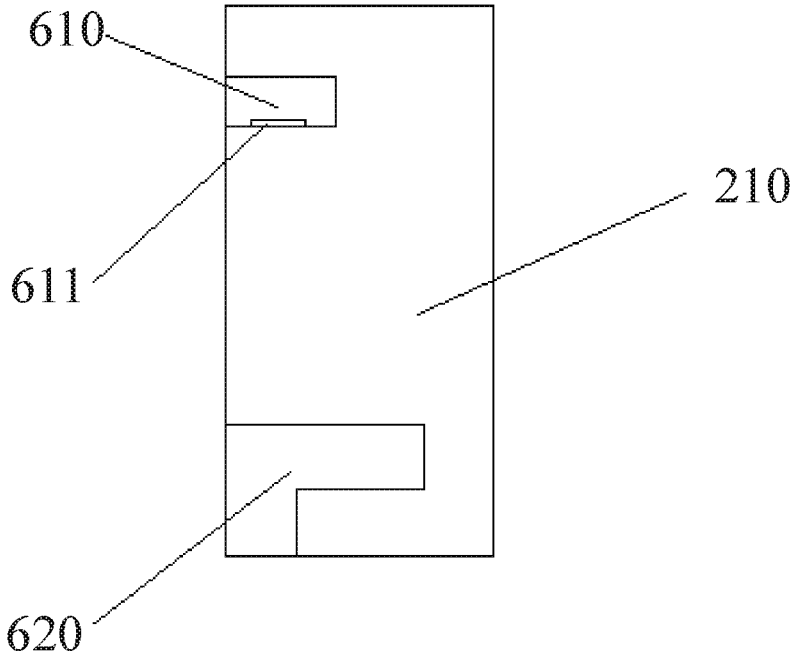
FIG. 6A illustrates a side view of an exemplary housing in a socket in accordance with some embodiments of this disclosure.
Figure 6B:
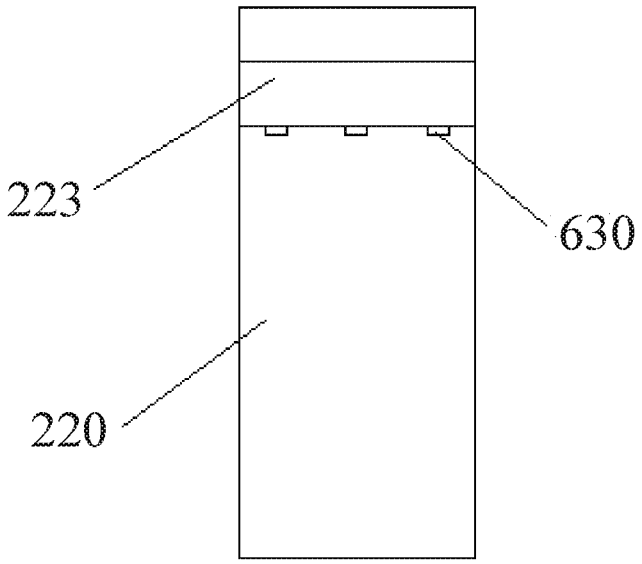
FIG. 6B illustrates a front view of an exemplary plug in a socket in accordance with some embodiments of this disclosure.
Figure 6C:
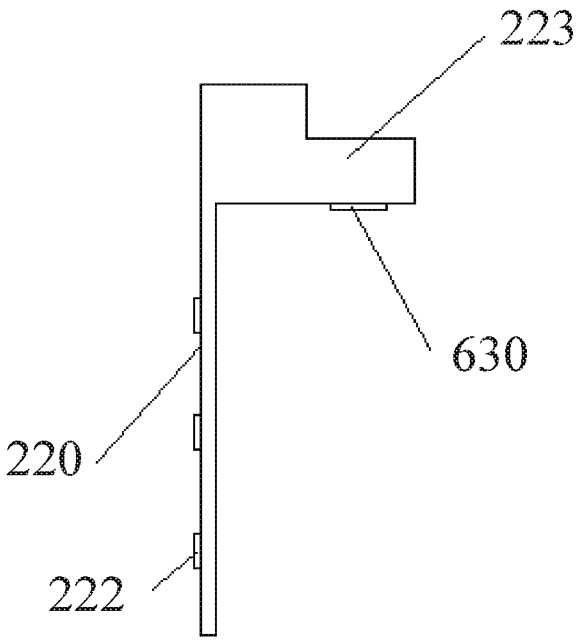
FIG. 6C illustrates a side view of an exemplary plug in a socket in accordance with some embodiments of this disclosure.
Figure 6D:
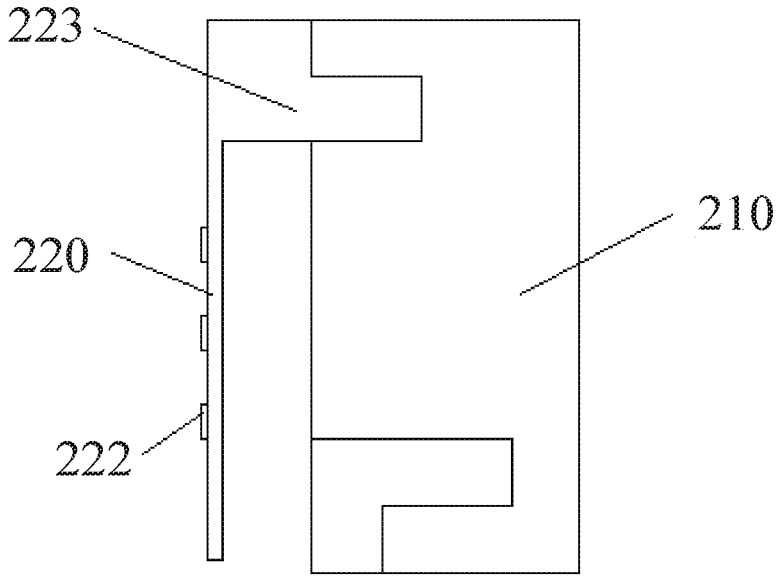
FIG. 6D illustrates a side view of an exemplary socket in functional state in accordance with some embodiments of this disclosure.
Figure 6E:
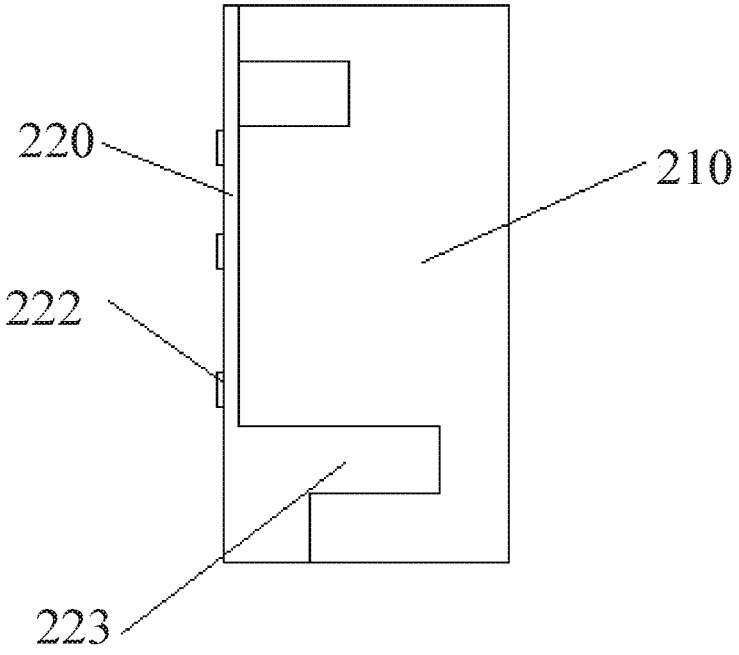
FIG. 6E illustrates a side view of an exemplary socket in non-functional state in accordance with some embodiments of this disclosure.

FIGS. 6A to 6E illustrate an exemplary connection between plug 220 and housing 210 in according with some embodiments of this disclosure. FIG. 6A illustrates a side view of housing 210. FIG. 6B illustrates a front view of plug 220. FIG. 6C illustrates a side view of plug 220. Housing 210 may include a connecting groove 610, an inner contact point 611 and a retracting groove 620. Connecting groove 610 and retracting groove 620 may be positioned on the back side of the housing 210. Inner contact point 611 may be positioned in the connecting groove 610. Inner contact point 611 may be connected to clamping conducting strip 212. Connector 223 may be positioned on the top of plug 220. External contact point 630 may be positioned on the connector 223. External contact point 630 may be connected to (e.g., electrically connected to) elastic conducting contact 222. When connector 223 of plug 220 is inserted into the connecting groove 610, plug 220 may be hung on the back of the housing 210, and there may be a space between plug 220 and housing 210 for the plug 220 to get a power supply. When connector 223 of plug 220 is inserted into the connecting groove 610, inner contact point 611 may be connected to (e.g., electrically connected to) external contact point 630 of plug 220, that is the functional state of the plug 220 as shown in FIG. 6D. Connecting groove 610 and connector 223 may be configured in any suitable size and shape to match each other. The size and/or shape of connecting groove 610 and connector 223 may not be limited to those shown in the figures. Connecting groove 610 may be arranged in any suitable manner on housing 210. In some embodiments, connecting groove 610 can be positioned on the upper part of the back side of the housing 210. In some embodiments, connecting groove 610 can be positioned on the middle part of the back side of the housing 210. In some embodiments, connecting groove 610 can be positioned at the bottom part of the back side of the housing 210. When connector 223 of plug 220 is inserted into the retracting groove 620, plug 220 may be in proximity to the back side of housing 210, that is the retraction status of the plug as shown in FIG. 6E. Retracting groove 620 may be arranged in any suitable manner on housing 210. In some embodiments, retracting groove 620 may be positioned on the upper part of the back side of the housing 210. In some embodiments, retracting groove 620 may be positioned on the middle part of the back side of the housing 210. In some embodiments, retracting groove 620 may be positioned on the bottom part of the back side of the housing 210. The number of inner contact point 610 of housing 210, the number of external contact point 630 of plug 220, and/or the number of elastic conducting contact may correspond to the number of slots and/or holes of a socket. For example, two elastic conducting contacts, two inner contact points, and two external contact points may be implemented for a socket with two slots and/or holes. For example, three elastic conducting contacts, three inner contact points, and three external contact points may be implemented for a socket with three slots and/or holes. At least two elastic conducting contacts may be positioned on the plug 220. In some embodiments, elastic conducting contacts may be positioned on different sides of the plug 220. For example, elastic conducting contacts may be positioned on the front side and back side of the plug 220 or on the left side and right side of the plug 220. In some embodiments, at least one elastic conducting contact may be positioned at the bottom of the plug 220. When the number of elastic conducting contacts is two, the two elastic conducting contacts may be configured to connect to (e.g., electrically connected to) a hot wire and a neutral wire, respectively. When the number of elastic conducting contacts is three, the three elastic conducting contacts may be configured to electrically connect to a hot wire, a neutral wire, and a ground wire, respectively. In some embodiments, the three elastic conducting contacts may be placed at different positions (e.g., different heights). For example, the elastic conducting contacts configured to connect to (e.g., electrically connect to) the hot wire may be closest to the insertion end of the plug 220.

Elastic conducting contact 222 may have any type of surface. For example, elastic conducting contact 222 may have a curved surface in some embodiments (e.g., a surface as shown in FIG. 8A). In some embodiments in which the elastic conducting contacts have a curved surface, the corresponding conductor in power outlet strip may be configured as a contact piece. As another example, elastic conducting contact 222 may have a stepped surface (e.g., a surface as shown in FIG. 8B). When elastic conducting contact have a stepped surface, the corresponding conductor in power outlet strip may be configured in shape of a cylinder. The cross sectional area of elastic conducting contact 222 may be 0.1 $mm^2$ to 100.0 $mm^2$. In some embodiments, the cross sectional area of elastic conducting contact 222 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional area of elastic conducting contact 222 may be 2 $mm^2$. The cross sectional areas of different elastic conducting contacts 222 may or may not be the same. Elastic conducting contact 222 may have any coefficient of elasticity, such as, 0.1, 0.2, 0.3, 0.4, 0.5, 0.6, 0.7, 0.8, 0.9 or any other suitable values.

As illustrated in FIG. 6C, the vertical distance between the top elastic conducting contact 222 and the top end of plug 220 may be 0-100 mm. In some embodiments, the vertical distance between the top elastic conducting contact 222 and the top end of plug 220 may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, 9.1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, or 90.1 mm~100.0 mm, etc. In some embodiments, the vertical distance between the top elastic conducting contact 222 and the top end of plug 220 may be 12.0 mm. Different plugs may or may not have the same vertical distance between the top elastic conducting contact 222 and the top end of the plug 220.

As illustrated in FIG. 6C, the vertical distance between adjacent elastic conducting contacts 222 of the three elastic conducting contacts may be 0~100 mm. In some embodiments, the vertical distance between adjacent elastic conducting contacts 222 of the three elastic conducting contacts may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, 9.1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, or 90.1 mm~100.0 mm, etc. In some embodiments, the vertical distance between adjacent elastic conducting contacts 222 of the three elastic conducting contacts may be 8.5 mm. Different plugs may or may not have the same vertical distance between adjacent elastic conducting contacts 222 of the three elastic conducting contacts.

The deformation degree of elastic conducting contact 222 in normal operations may be 0~100 mm. In some embodiments, deformation degree of elastic conducting contact 222 in normal operation may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, 9.1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, or 90.1 mm~100.0 mm, etc. In some embodiments, deformation degree of elastic conducting contact 222 in normal operation may be 0.6 mm. The deformation degrees of different elastic conducting contacts 222 in normal operation may or may not be the same.

Figure 7A:
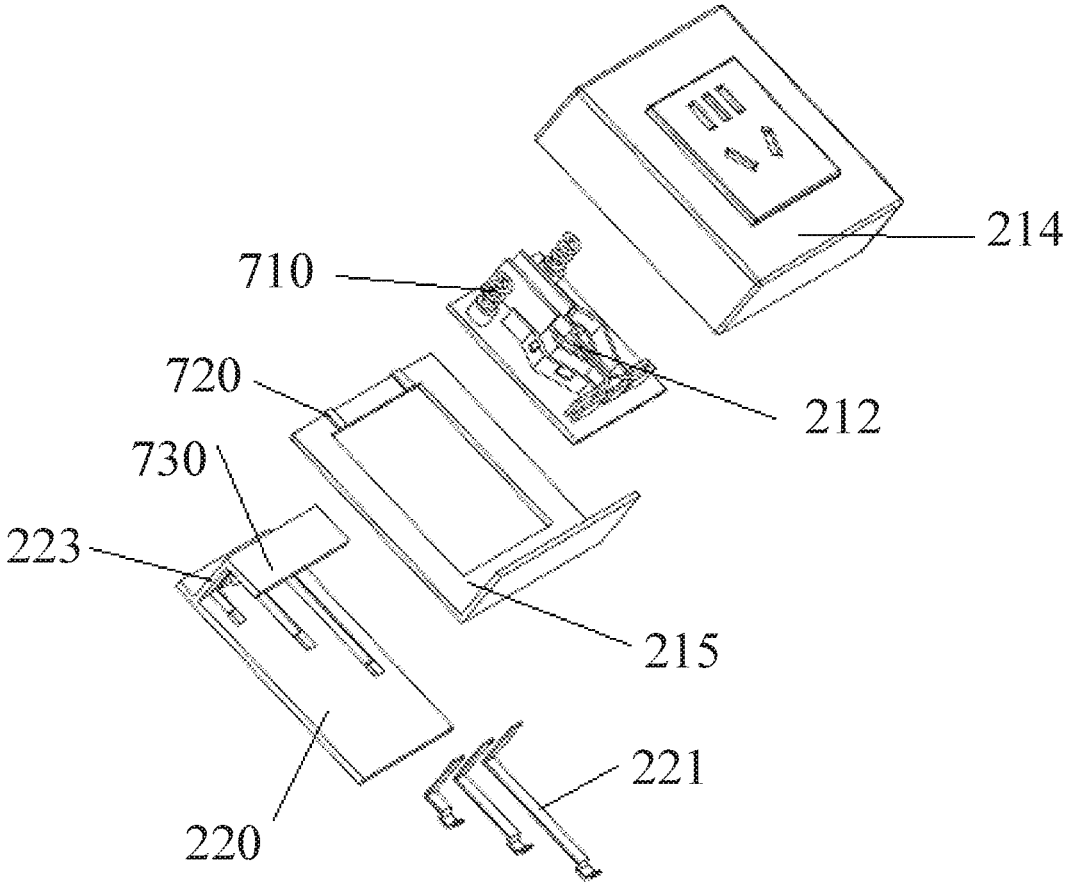
FIG. 7A illustrates a partial exploded view of an exemplary socket in accordance with some embodiments of this disclosure.
Figure 7B:
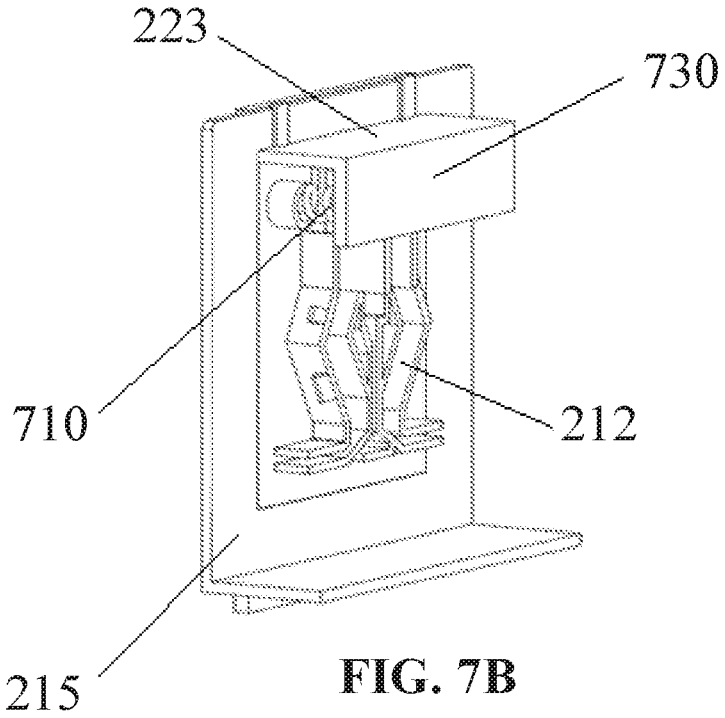
FIG. 7B illustrates an exemplary rear housing in accordance with some embodiments of this disclosure.
Figure 7C:
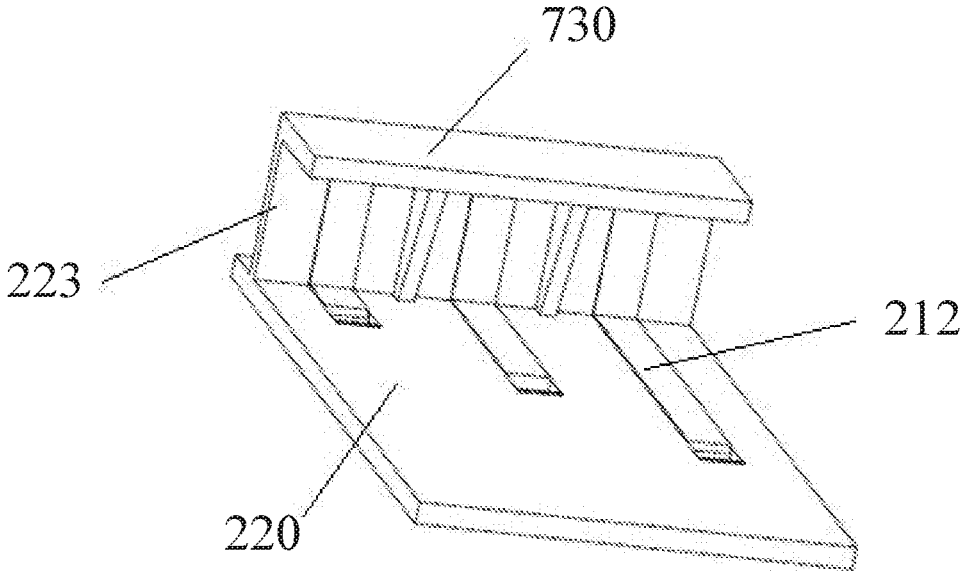
FIG. 7C illustrates an exemplary plug in a socket in accordance with some embodiments of this disclosure.

As illustrated in FIGS. 7A to 7E, a spring may be configured to control the state of the housing and the plug of a socket module in accordance with some embodiments of this disclosure. FIG. 7A to 7C illustrate a mobile hanging socket. The socket may include a housing 210 and a plug 220. Plug 220 may be hung out of the housing 210. Housing 210 may include a front housing 214 and a rear housing 215. At least one side of housing 210 may include multiple slots and/or holes configured to connect to one or more plugs. As shown in FIG. 7A, front housing 214 may include multiple slots and/or holes. The number and the shape of slots and/or holes may not be limited to those shown in the figures. In some embodiments, housing 210 may include two slots and/or holes. In some embodiments, housing 210 may include three slots and/or holes. In some embodiments, housing 210 may include five slots and/or holes. In some embodiments, the slots and/or holes may be circular. In some embodiments, the slots and/or holes may be rectangular. In some embodiments, the slots and/or holes configured to be connected to plug and clamping conducting strip in the slots and/or holes may be replaced by other electrical device. The other electrical device may include a router, a sensor, an alarm, a detector, a camera, a charger or a converter. In some embodiments, housing 210 may include a cavity configured to install an intelligent chip.

In some embodiments, plug 220 may include a connector 223. The connector may be positioned in the upper part of the plug 220 as shown in FIG. 7A. The position of connector in FIG. 7A is presented by way of example, and the disclosure may not be limited to the embodiments as enumerated above. Connector 223 may be arranged in any suitable manner on plug 220. In some embodiments, connector 223 may be positioned in the middle part of the plug 220. In some embodiments, connector 223 may be positioned in the bottom part of the plug 220. Connector 223 may include a back plate 730. Back plate 730 may be configured in any width that is less than the width of housing 210. Back plate 730 may be configured in any height that is lower than the height of housing 210. Back plate 730 may be configured in any thickness that is thinner than the thickness of housing 210.

Plug 220 may include a connecting conducting strip 221. One end of connecting conducting strip 221 may form an elastic conducting contact 222. The other end of connecting conducting strip 221 may be connected to (e.g., electrically connected to) clamping conducting strip 212. A slot 720 may be positioned on the rear housing 215 of housing 210. The size of slot 720 may correspond to that of connector 223. Connector 223 of plug 220 may be inserted into the slot 720 so that back plate 730 may be located inside the housing 210 and/or that plug 220 may be located outside of the housing 210. Elastic conducting contact 221 may be connected to (e.g., electrically connected to) clamping conducting strip 212 through a conductor. The conductor may be an elastic conductor. When contacting with other conductors, the elastic conductor may be elastically deformed and produce elastic pressure so that it may be more firmly connected to other conductors. In some embodiments, the conductor may be an elastic copper strip. The conductor may be made of any conductive material, such as copper, brass, phosphor bronze, beryllium bronze, red copper, rose copper, copper alloy, copper cadmium alloy, copper nickel alloy, tin copper alloy, etc.

Figure 7D:
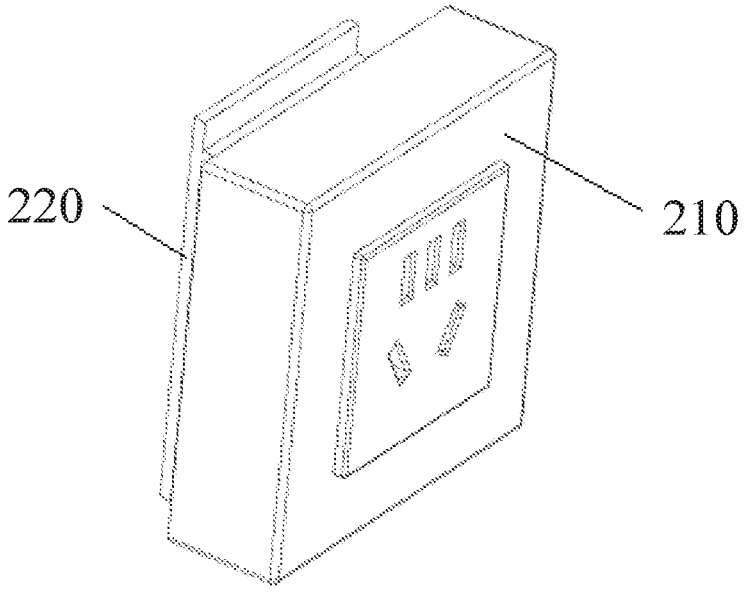
FIG. 7D illustrates an exemplary socket in non-functional state in accordance with some embodiments of this disclosure.
Figure 7E:
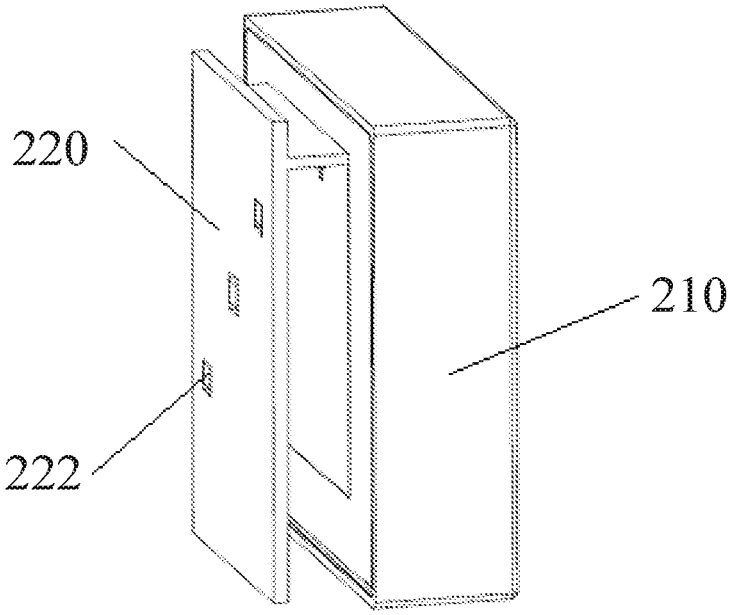
FIG. 7E illustrates an exemplary socket in functional state in accordance with some embodiments of this disclosure.

Spring 710 may be positioned between rear housing 215 and back plate 730 to resist back plate 730. Housing 210 may include any number of springs, such as one, two, three, four, etc. Spring 710 may be arranged in any suitable manner in the housing. The number and position of spring 710 in FIGS. 7A and 7B are presented by way of example, and the disclosure may not be limited to the embodiments as enumerated above. As shown in FIG. 7D, in a non-functional state, spring 710 may resist back plate 730 so that plug 220 may be in proximity to the back side of housing 210. As shown in FIG. 7E, in a functional state, plug 220 may be pulled outward and spring 710 may be compressed by back plate 730 so that there may be a space between plug 220 and the back side of housing 210 for plug 220 to receive a power supply.

Plug 220 may be bended or twisted to a certain degree. Plug 220 may be bended to any degree, such as, ±1°, ±2°, ±3°, ±4°, ±5° or any other degree. Plug 220 may be twisted to any degree, such as, ±1°, ±2°, ±3°, ±4°, ±5° or any other degree.

Figure 9A:
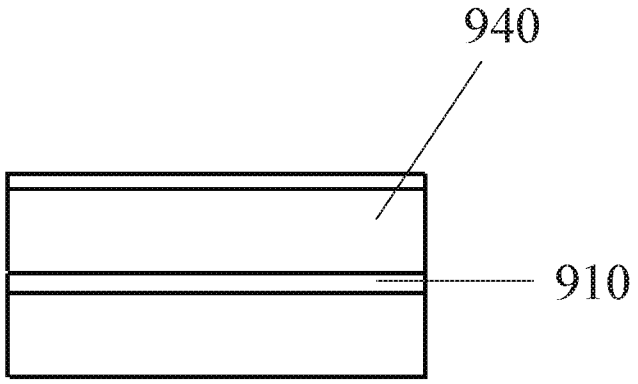
FIG. 9A illustrates a top view of an exemplary power outlet strip in accordance with some embodiments of this disclosure.
Figure 9B:
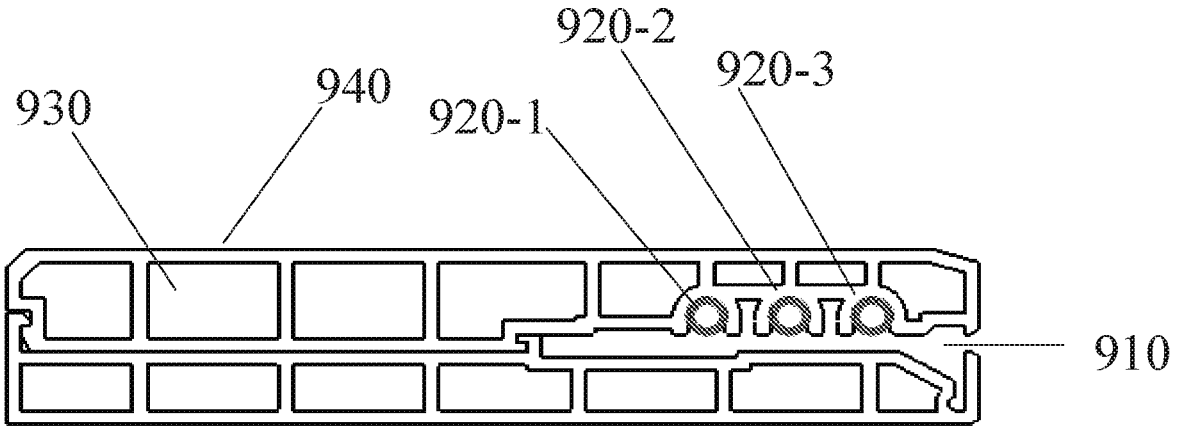
FIG. 9B illustrates a partial exploded view of an exemplary power outlet strip in accordance with some embodiments of this disclosure.

FIG. 9A illustrates a top view of an exemplary power outlet strip in accordance with some embodiments of this disclosure. FIG. 9B illustrates a partial exploded view of an exemplary power outlet strip.

As shown in FIGS. 9A and 9B, power outlet strip 940 may include an insertion groove 910. Power outlet strip 940 may be made of any un-conductive material, such as, woods, plastic, rubber, ceramic, granite, etc. In some embodiments, the depth of insertion groove 910 may be greater than the inserted depth of plug 220. In some embodiments, the depth of insertion groove 910 may be equal to or substantially equal to the insertion depth of plug 220. In some embodiments, the depth of insertion groove 910 may be smaller than the insertion depth of plug 220. In some embodiments, the width of insertion groove 910 may be greater than the thickness of plug 220. In some embodiments, the width of insertion groove 910 may be equal to or substantially equal to the thickness of plug 220.

In some embodiments, power outlet strip 940 may include a sealed and insulated component (not shown in the figures). The sealed and insulated component may prevent people or animals from accidently touching the conductors in power outlet strip 940 through insertion groove 910. The sealed and insulated component may prevent water or vapor from leaking into power outlet strip 940 through insertion groove 910. The sealed and insulated component may be positioned on the inner surface of insertion groove 910. The sealed and insulated component may be open when plug 220 is inserted into the power outlet strip 940. The sealed and insulated component may be closed when plug 220 is pulled from the power outlet strip 940. In some embodiments, the sealed and insulated component may be a flexible piece or a rigid piece. The sealed and insulated component may be made of rubber.

As shown in FIGS. 9A and 9B, power outlet strip 940 may include one or more conductors, such as conductors 920-1, 920-2, and 920-3. The three conductors may be a hot wire, a ground wire, and a neutral wire, respectively. In some embodiments, conductors 920-1, 920-2, and/or 920-3 may be hollow. In some embodiments, conductors 920-1, 920-2, and/or 920-3 may be solid. The conductors 920-1, 920-2, and 920-3 may be made of any conductive material, such as, copper, brass, phosphor bronze, beryllium bronze, red copper, rose copper, copper alloy, copper cadmium alloy, copper nickel alloy, tin copper alloy, etc. The cross sectional area of conductors 920-1, 920-2, and/or 920-3 may be 0.1 $mm^2$ to 100.0 $mm^2$. In some embodiments, the cross sectional area of conductors 920-1, 920-2, and/or 920-3 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional areas of conductors 920-1, 920-2, and/or 920-3 may be 5.5 $mm^2$.

As shown in FIGS. 9A and 9B, the horizontal distance between conductor 920-3 and the opening of insertion groove 910 may be 0-100 mm. In some embodiments, the horizontal distance between conductor 920-3 and the opening of insertion groove 910 may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, 9.1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, 90.1 mm~100.0 mm, etc. In some embodiments, the horizontal distance between conductor 920-3 and the opening of insertion groove 910 may be 11.0 mm. The horizontal distances between conductor 920-3 and the opening of insertion groove 910 in different power outlet strips may or may not be the same.

As shown in FIGS. 9A and 9B, the horizontal distance between adjacent conductors of conductors 920-1, 920-2, and/or 920-3 may be 0-100 mm. In some embodiments, the horizontal distance between adjacent conductors 920 of conductors 920-1, 920-2, and/or 920-3 may be 0.1 mm~1.0 mm, 1.1 mm~2.0 mm, 2.1 mm~3.0 mm, 3.1 mm~4.0 mm, 4.1 mm~5.0 mm, 5.1 mm~6.0 mm, 6.1 mm~7.0 mm, 7.1 mm~8.0 mm, 8.1 mm~9.0 mm, 9.1 mm~10.0 mm, 10.1 mm~20.0 mm, 20.1 mm~30.0 mm, 30.1 mm~40.0 mm, 40.1 mm~50.0 mm, 50.1 mm~60.0 mm, 60.1 mm~70.0 mm, 70.1 mm~80.0 mm, 80.1 mm~90.0 mm, or 90.1 mm~100.0 mm, etc. In some embodiments, the horizontal distance between adjacent conductors 920 of conductors 920-1, 920-2, and/or 920-3 may be 8.5 mm. The horizontal distance between adjacent conductors of conductors 920-1, 920-2, and/or 920-3 in different power outlet strip may or may not be the same.

The maximum current that conductors 920-1, 920-2, and/or 920-3 can safely withstand may be 0-100 A. In some embodiments, the maximum current that conductors 920-1, 920-2, and/or 920-3 can safely withstand may be 0.1 A~1.0 A, 1.1 A~2.0 A, 2.1 A~3.0 A, 3.1 A~4.0 A, 4.1 A~5.0 A, 5.1 A~6.0 A, 6.1 A~7.0 A, 7.1 A~8.0 A, 8.1 A~9.0 A, 9.1 A~10.0 A, 10.1 A~20.0 A, 20.1 A~30.0 A, 30.1 A~40.0 A, 40.1 A~50.0 A, 50.1 A~60.0 A, 60.1 A~70.0 A, 70.1 A~80.0 A, 80.1 A~90.0 A, or 90.1 A~100.0 A, etc. In some embodiments, maximum current that conductors 920-1, 920-2, and/or 920-3 can safely withstand may be 40 A. The maximum currents that different conductors 920-1, 920-2, and/or 920-3 can safely withstand may be the same as or different from each other.

The maximum voltage that conductors 920-1, 920-2, and/or 920-3 can safely withstand may be 0-10000V. In some embodiments, the maximum voltage that conductors 920-1, 920-2, and/or 920-3 can safely withstand may be 10V~100V, 110V~200V, 210V~300V, 310V~400V, 410V~500V, 510V~600V, 610V~700V, 710V~800V, 810V~900V, 910V~1000V, 1010V~2000V, 2010V~3000V, 3010V~4000V, 4010V~5000V, 5010V~6000V, 6010V~7000V, 7010V~8000V, 8010V~9000V, or 9010V~1000V, etc. In some embodiments, the maximum voltage that conductors 920-1, 920-2, and/or 920-3 can safely withstand may be 5000V. The maximum voltages that different conductors 920-1, 920-2, and/or 920-3 can safely withstand may or may not be the same.

The contact area between elastic conducting contact 222 and conductors 920-1, 920-2, and/or 920-3 may be 0.1 $mm^2$~100.0 $mm^2$. The contact area between elastic conducting contact 222 and conductors 920-1, 920-2, and/or 920-3 may be 0.1 $mm^2$ to 100.0 $mm^2$. In some embodiments, the contact area between elastic conducting contact 222 and conductors 920-1, 920-2, and/or 920-3 may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the contact area between elastic conducting contact 222 and conductors 920-1, 920-2, and/or 920-3 may be greater than 2 $mm^2$. The contact areas between different elastic conducting contacts 222 and conductors 920-1, 920-2, and/or 920-3 may or may not be the same.

The pressure of elastic conducting contact 222 in a functional state on conductors 920-1, 920-2, and/or 920-3 may be 0-100N. In some embodiments, the pressure of elastic conducting contact 222 in a functional state on conductors 920-1, 920-2, and/or 920-3 may be 0.1N~1.0N, 1.1N~2.0N, 2.1N~3.0N, 3.1N~4.0N, 4.1N~5.0N, 5.1N~6.0N, 6.1N~7.0N, 7.1N~8.0N, 8.1N~9.0N, 9.1N~10.0N, 10.1N~20.0N, 20.1N~30.0N, 30.1N~40.0N, 40.1N~50.0N, 50.1N~60.0N, 60.1N~70.0N, 70.1N~80.0N, 80.1N~90.0N, or 90.1N~100.0N, etc. In some embodiments, the pressure of elastic conducting contact 222 in a functional state on conductors 920-1, 920-2, and/or 920-3 may be 7.5N. The pressures of different elastic conducting contacts 222 in a functional state on conductors 920-1, 920-2, and/or 920-3 may or may not be the same.

Power strip system 120 may include three conductor grooves. Three conductors may be positioned in the conductor grooves. A hot wire, a ground wire, and a neutral wire may be arranged in any suitable manner. In some embodiments, conductor 920-1 may be the hot wire. In some embodiments, conductor 920-2 may be the hot wire. In some embodiments, conductor 920-3 may be the hot wire. The three conductors in FIG. 9B may be positioned on the same side of the insertion groove 910. In some embodiments, the three conductors may be positioned on different sides of the insertion groove 910. In some embodiments, any two of three conductors may be positioned on the same side of the insertion groove 910, and the other one may be positioned on the other side of the insertion groove 910. In some embodiments, any two of three conductors may be respectively positioned on two sides of the insertion groove 910, and the other one may be positioned at the bottom of the insertion groove 910. It should be noted that the number and positons of conductors in power outlet strip in FIG. 9B may be presented by way of example, and the disclosure may not be limited to embodiments as enumerated above. In some embodiments, power outlet strip 940 may include two conductors that may be a hot wire, a neutral wire, respectively. In some embodiments, the conductors may be positioned on the same side of the insertion groove 910. In some embodiments, the two conductors may be positioned on different sides of the insertion groove 910. In some embodiments, one conductor may be positioned on any side of the insertion groove 910, and the other conductor may be positioned at bottom of the insertion groove 910.

As shown in FIG. 9B, power outlet strip 940 may include multiple cavities 930. In some embodiments, a hot wire, a ground wire, and a neutral wire may be positioned in the cavities. The hot wire, the ground wire, and neutral wire may be positioned in the same cavity or in different cavities. Cavity 930 may have other alternative uses. Power outlet strip 940 can have any suitable number of cavities (e.g., one, two, three, four, five, etc.). The length of cavity 930 and the length of power outlet strip 940 may or may not be the same. The cross-section of cavity 930 may be configured in any regular shape or irregular shape. The regular shape may include circular, triangular, quadrilateral, pentagon, hexagon or any other regular shape. The cross-sections of different cavities 930 may or may not be the same.

In some embodiments, insertion groove 910 of power outlet strip 940 may include a dustproof and insulated portion. The dustproof and insulated portion may prevent dust or water vapor from falling into power outlet strip. The dustproof and insulated portion may be a rubber strip.

It should be noted that descriptions above in relation to the power outlet strip may be presented by way of example, and the disclosure may not be limited to embodiments as enumerated above. It is understood that numerous other changes, substitutions, variations, alterations, and modifications of positions may be ascertained to one skilled in the art after understanding the setting principles of conductors. In some embodiments, power outlet strip may be solid and not include a cavity. Such changes, substitutions, variations, alterations, and modifications as falling within the scope of this disclosure.

Figure 10A:
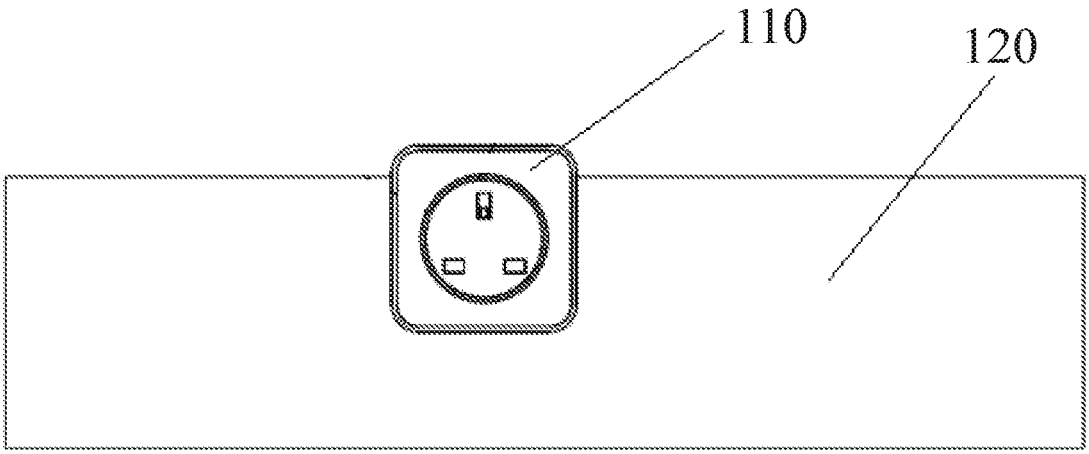
FIG. 10A illustrates a front view of an exemplary power outlet system in accordance with some embodiments of this disclosure.
Figure 10B:
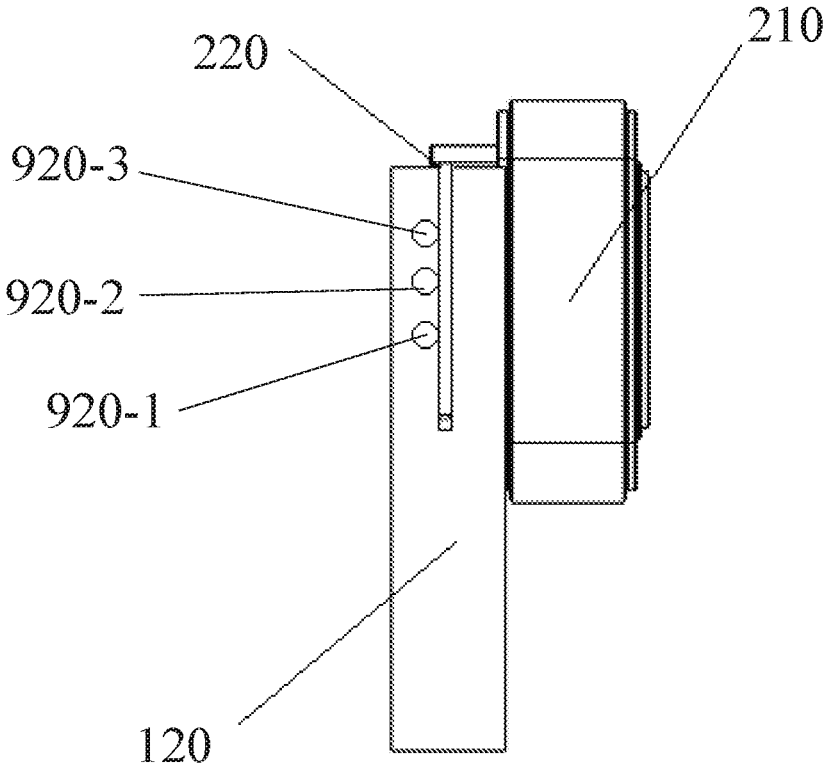
FIG. 10B illustrates a side view of an exemplary power outlet system in accordance with some embodiments of this disclosure.

FIGS. 10A and 10B illustrate a front view and a side view of an exemplary socket module 110 and power strip system 120 in a functional state in accordance with some embodiments of this disclosure. Socket module 110 may include housing 210 and plug 220. Power strip system 120 may be can be compatible with socket module 110. Power outlet strip 120 may be installed on the surface of walls or other fixed objects such as a furniture. Compared with traditional ways of wiring, the way of wiring described above greatly reduce the complexity of decoration and may be easily installed. Power strip system 120 may include an insertion groove 910 on its top surface. A hot wire 130, a neutral wire 140, and a ground wire 150 may be positioned in the power outlet strip to be connected to (e.g., be electrically connected to) plug 220. Socket module 110 may be energized when plug 220 is inserted into the insertion groove 910 of power outlet strip 940. Insertion groove 910 may be configured in suitable size and shape to correspond to the size and shape of plug 220. In some embodiments, when plug 220 is connected to (e.g., electrically connected to) the power outlet strip 120, the indicator light may be connected to (e.g., electrically connected to) the connecting conducting strip and be activated to show that the socket module 110 is energized. When socket module 110 is not connected or badly connected to power outlet strip 120, the indicator light in the socket module 110 may not be activated to show that the socket module 110 is not energized.

In some embodiments, power outlet strip 910 may include three conductors: a hot wire, a ground wire, and a neutral wire. The conductors may be rigid conductors. When socket module 110 is inserted into the power outlet strip, elastic conducting contact 222 on the surface of plug 220 may be connected to (e.g., electrically connected to) the three rigid conductors. In some embodiments, elastic conducting contact 222 may be positioned on the same surface of the plug 220 and respectively connected to the three rigid conductors. Elastic conducting contacts 222 may be squeezed by rigid conductor so that they may be more tightly connected to each other and socket may be stably and reliably energized. At the same time, the three conductors may not be deformed and will not affect the operations of other mobile sockets. In some embodiments, elastic conducting contact 222 may not be positioned on the same surface of the plug 220.

Figure 11A:
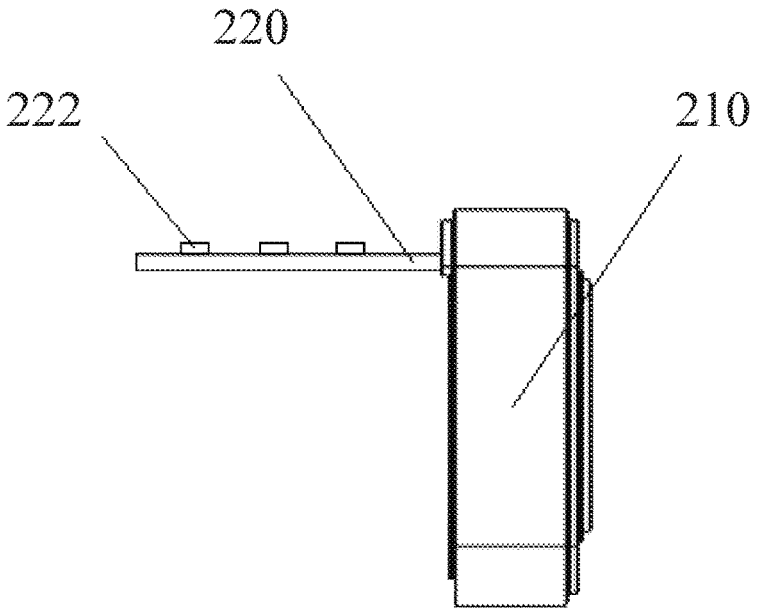
FIG. 11A illustrates a side view of an exemplary socket in accordance with some embodiments of this disclosure.
Figure 11B:
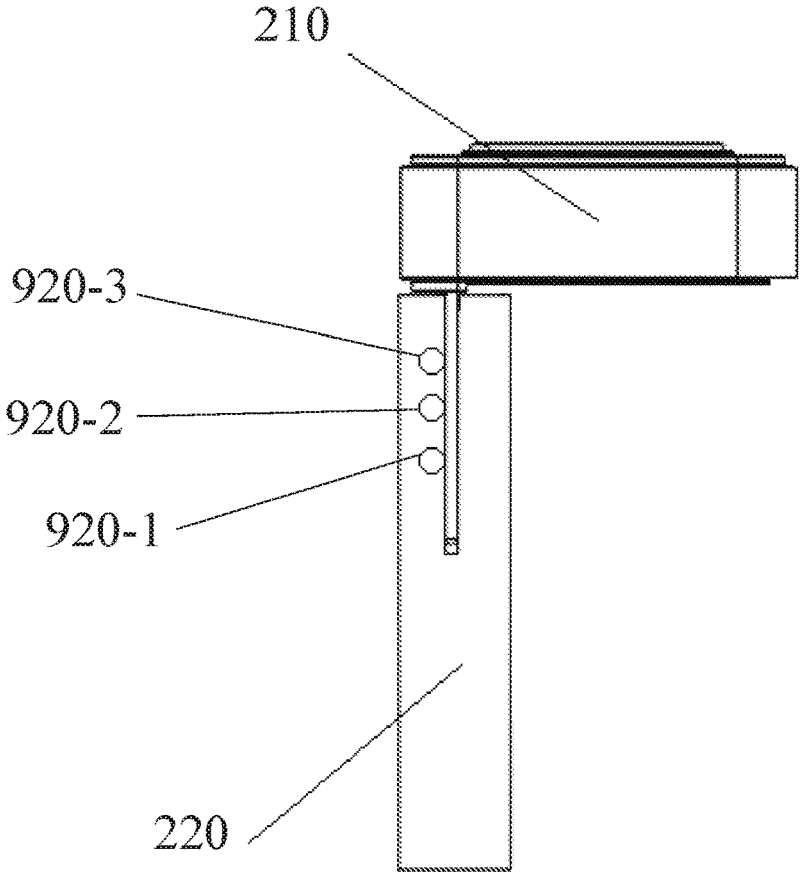
FIG. 11B illustrates a side view of an exemplary power outlet system in accordance with some embodiments of this disclosure.

FIG. 11A illustrates a side view of an exemplary socket module in accordance with some embodiments of this disclosure. FIG. 11B illustrates a side view of an exemplary socket module and power outlet strip in functional state in accordance with some embodiments of this disclosure. Socket module 110 may include a plug 220 and a housing 210. Plug 220 may be arranged perpendicular to the external surface of housing 210. One end of connecting conducting strip 221 may be positioned in the housing 210 and may be connected to (e.g., electrically connected to) socket core 211 and indicator light 213. The other end of connecting conducting strip 221 may be extended into plug 220 and form an elastic conducting contact 222 on the surface of plug 220. Power outlet strip 940 may include an insertion groove 910 on its top surface. When plug 220 is inserted into the insertion groove 910 of power outlet strip 940, socket module 110 may be energized. When plug 220 is connected to (e.g., electrically connected to) the power outlet strip 940, the indicator light may be connected to (e.g., electrically connected to) connecting conducting strip and be activated to show that socket module 110 is energized. When plug 220 is not connected or badly connected to power outlet strip 940, the indicator light of socket module 110 may not be activated to show that socket module 110 is not energized.

Figure 12:
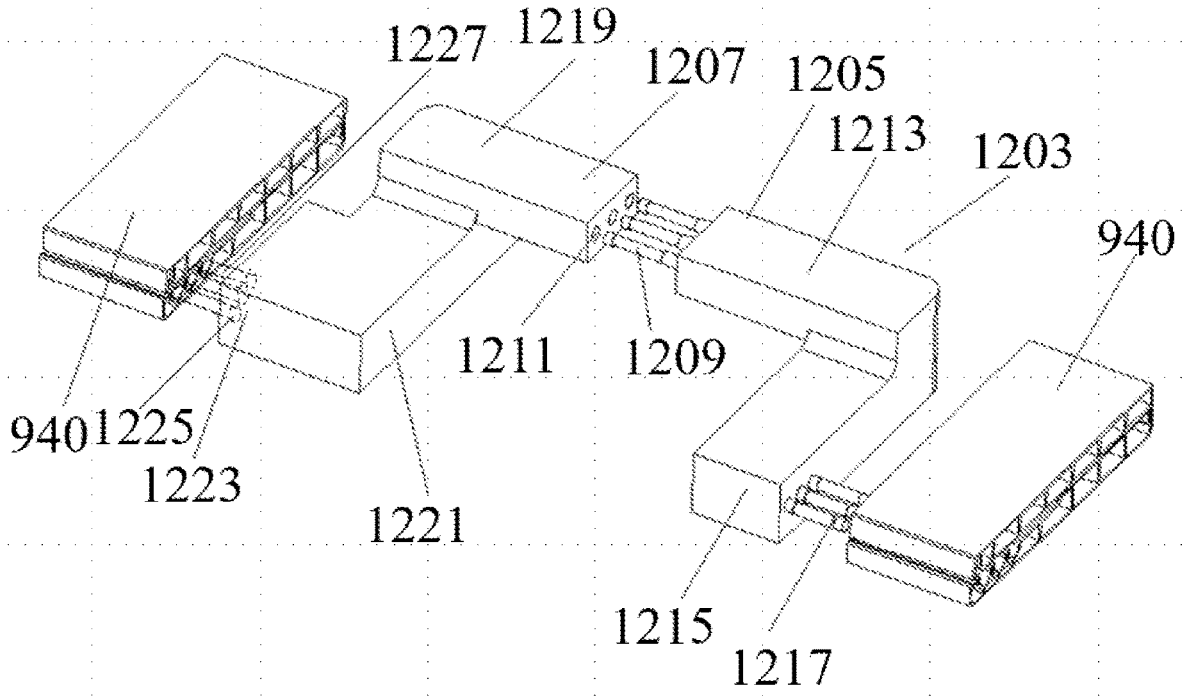
FIG. 12 illustrates an exemplary power strip system in accordance with some embodiments of this disclosure.

FIG. 12 illustrates an exemplary power strip system in accordance with some embodiments of this disclosure. The power strip system may include one or more power outlet strips 940 and one or more strip connectors 1203. In some embodiments, power outlet strip 940 may extend along a certain direction. When power outlet strip 940 meets an object in the direction, strip connector 1203 may bypass the object to establish connections between power outlet strips 940 on both sides of the object. In some embodiments, examples of the object may include supports in the middle of the hall, columns protruded from the wall. Strip connector 1203 may bypass square-shaped object (e.g., an obstacle in shape of "⎍", circular arc shaped objects, curved objects, and any other object. The corresponding shape of cross-sections of strip connector 1203 may include square, circular arc, curved shape, etc.

In some embodiments, strip connector 1203 may include a connecting joint 1205 and a connecting interface 1207. Connecting joint 1205 may include a first conductor 1209. Connecting interface 1207 may include a second conductor 1211. First conductor 1209 may protrude from connecting joint 1205, and second conductor 1211 may be positioned in the connecting interface 1207. The shape of first conductor 1209 may be rectangular, cylinder, or sphere, etc. The shape of second conductor 1211 may be rectangular, cylinder, or sphere, etc. In some embodiments, first conductor 1209 may be a conducting bar, and second conductor 1211 may be a conducting tube.

In some embodiments, the cross sectional area of first conductor 1209 and second conductor 1211 may be 0.1 $mm^2$ to 100.0 $mm^2$. In some embodiments, the cross sectional area of conductors may be 0.1 $mm^2$~1.0 $mm^2$, 1.1 $mm^2$~2.0 $mm^2$, 2.1 $mm^2$~3.0 $mm^2$, 3.1 $mm^2$~4.0 $mm^2$, 4.1 $mm^2$~5.0 $mm^2$, 5.1 $mm^2$~6.0 $mm^2$, 6.1 $mm^2$~7.0 $mm^2$, 7.1 $mm^2$~8.0 $mm^2$, 8.1 $mm^2$~9.0 $mm^2$, 9.1 $mm^2$~10.0 $mm^2$, 10.1 $mm^2$~20.0 $mm^2$, 20.1 $mm^2$~30.0 $mm^2$, 30.1 $mm^2$~40.0 $mm^2$, 40.1 $mm^2$~50.0 $mm^2$, 50.1 $mm^2$~60.0 $mm^2$, 60.1 $mm^2$~70.0 $mm^2$, 70.1 $mm^2$~80.0 $mm^2$, 80.1 $mm^2$~90.0 $mm^2$ or 90.1 $mm^2$~100.0 $mm^2$, etc. In some embodiments, the cross sectional areas of first conductor 1209 and second conductor 1211 may be 5.5 $mm^2$.

In some embodiments, the shape of first conductor 1209 and the shape of second conductor 1211 may be configured to match each other so that first conductor 1209 may be inserted into second conductor 1211. Connecting joint 1205 and connecting interface 1207 may be electrically connected when first conductor 1209 is inserted into second conductor 1211. In some embodiments, second conductor 1211 may protrude from connecting interface 1207, and first conductor 1209 may be positioned in the connecting joint 1205. Second conductor 1211 may be inserted into first conductor 1209.

In some embodiments, first conductor 1209 may be elastic. First conductor 1209 may be reacted into connecting joint 1205 when it is in non-functional state. First conductor 1209 may extend from connecting joint 1205 when it is in functional state. The functional state may refer to the state that strip connector 1203 is used to connect power outlet strips on both sides of an object. The non-functional state may refer to the state that strip connector 1203 is not used to connect power outlet strips on both sides of an object.

In some embodiments, first conductor 1209 and second conductor 1211 may be made of any conductive material. The conductive material may include metal, alloys, etc. The metal may include copper, aluminum, gold, etc. For example, first conductor 1209 and second conductor 1211 may be made of copper. In some embodiments, first conductor 1209 and second conductor 1211 may be manufactured by welding, integral forming, and/or any other suitable manufacturing process and/or combinations of manufacturing processes.

In some embodiments, connecting joint 1205 may include a first buckle 1213 and a first strip connector 1215. The first buckle 1213 and first strip connector 1215 may be manufactured by welding, integral forming, and/or any other suitable manufacturing process and/or combinations of manufacturing processes. First conductor 1209 may be positioned on one end of first buckle 1213. First strip connector 1215 may be connected the other end of first buckle 1213.

In some embodiments, the connection between first strip connector 1215 and first buckle 1213 may be a vertical connection, an acute angled connection, or a right angled connection, etc. The right angled connection may refer to that the first buckle 1213 and first strip connector 1215 are perpendicular to each other. For example, first strip connector 1215 and first buckle 1213 are perpendicularly connected to each other as shown in FIG. 12.

In some embodiments, a third conductor 1217 may be positioned on one end of the first strip connector 1215. Third conductor 1217 may be protruded from the first strip connector 1215. Third conductor 1217 may be elastic. Third conductor 1217 may be retracted into the first strip connector 1215 when third conductor 1217 is in non-functional state. Third conductor 1217 may extend from the first strip connector 1215 when third conductor 1217 is in functional state.

In some embodiments, third conductor 1217 may be made of any conductive material, such as metals, alloys, etc. The metals may include copper, aluminum, gold, etc. For example, third conductor 1217 may be a copper bar. The shape of third conductor 1217 may be rectangular, cylinder, or sphere, etc. In some embodiments, the number of third conductors 1217 may be larger than or equal to the number of conductors in power outlet strip 940. In a functional state, one or more copper bars of third conductor 1217 may be inserted into corresponding hollow conductors to establish an electrical connection between connecting joint 1205 and power outlet strip 940.

In some embodiments, connecting interface 1207 may include a second buckle 1219 and a second strip connector 1221. Second buckle 1219 and second strip connector 1221 may be manufactured by welding, integral forming, mechanical splicing, and/or any other manufacturing process or combination of manufacturing processes. Second conductor 1211 may be positioned on one end of the second buckle 1219. Second strip connector 1221 may be connected the other end of second buckle 1219.

In some embodiments, the connection between second strip connector 1221 and second buckle 1219 may be a vertical connection, an acute angled connection, or a right angled connection, etc. The right angled connection may refer to that the second buckle 1219 and the second strip connector 1221 may be perpendicular to each other. For example, second strip connector 1221 and second buckle 1219 are perpendicularly connected to each other as shown in FIG. 12.

In some embodiments, connecting housing 1223 may be positioned on one side of the second strip connector 1221. The shape of connecting housing 1223 may be configured to match the shape of power outlet strip 940. Connecting housing 1223 may include a cavity 1225. A fourth conductor 1227 may be positioned in the cavity 1225 to be connected to (e.g., electrically connected to) conductor in power outlet strip 940. In that way, second strip connector 1221 may be connected to (e.g., electrically connected to) power outlet strip 940 through connecting housing 1223. The second strip connector 1221 and connecting housing 1223 be manufactured by welding, integral forming, mechanical splicing, and/or any other manufacturing process or combination of manufacturing processes.

Figure 13A:
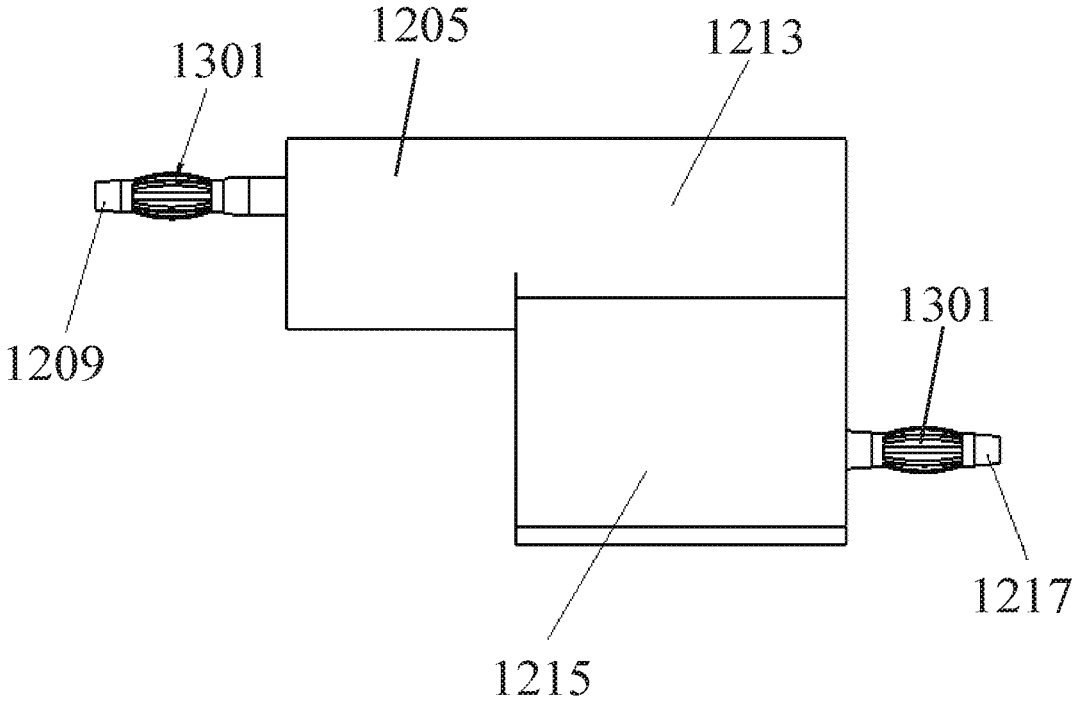
FIG. 13A illustrates a top view of an exemplary connecting joint in accordance with some embodiments of this disclosure.

FIG. 13A illustrates a top view of an exemplary connecting joint 1205 in accordance with some embodiments of this disclosure. Despite the descriptions above in relation to connecting joint 1205, one or more connectors 1301 may be positioned between first conductor 1209 and third conductor 1217. In some embodiments, connector 1301 may be a lantern-shaped connector (as shown in FIG. 13A). The diameter of connector 1301 may be larger than the diameter of the edge of first conductor 1209, or may be larger than the inside diameter of hollow conductor in power outlet strip 940. Connector 1301 may be made of any conductive material. Connector 1301 and the edge of first conductor 1209 may or may not be made of the same conductive material.

In some embodiments, the surface of connector 1301 may be elastic. When connecting joint 1205 and power outlet strip 940 are connected, the edge portion of third conductor 1217 may be firstly inserted into the hollow conductor in the power outlet strip 940, and connector 1301 may then be inserted into the hollow conductor in the power outlet strip 940. Connector 1301 may be squeezed and elastically deformed, and be completely or incompletely inserted into the hollow conductor in the power outlet strip 940.

Figure 13B:
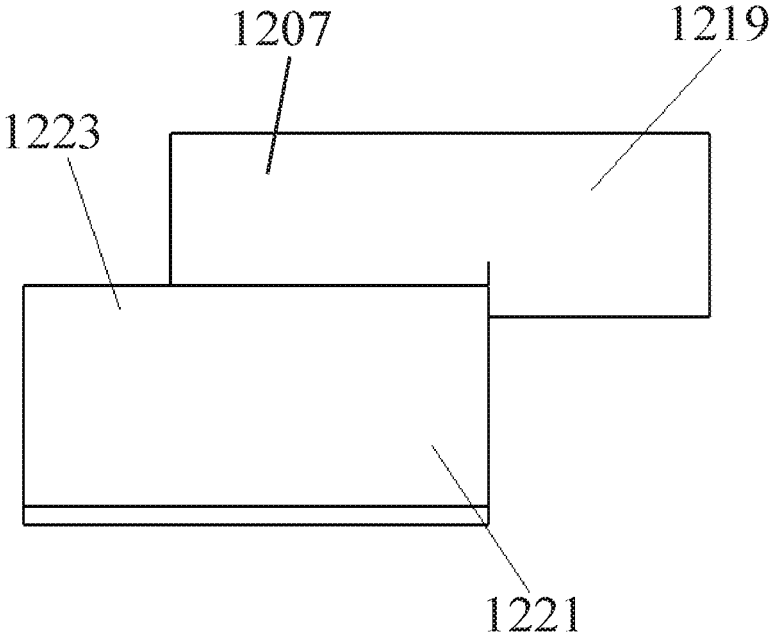
FIG. 13B illustrates a top view of an exemplary connecting interface in accordance with some embodiments of this disclosure.

FIG. 13B illustrates a top view of an exemplary connecting interface 1207 in accordance with some embodiments of this disclosure. As mentioned before, in some embodiments, connecting interface 1207 may include a second buckle 1219 and a second strip connector 1221. A connecting housing 1223 may be positioned on one side of the second strip connector 1221. Second strip connector 1221 may be electrically connected to power outlet strip 940 through connecting housing 1223.

Figure 14:
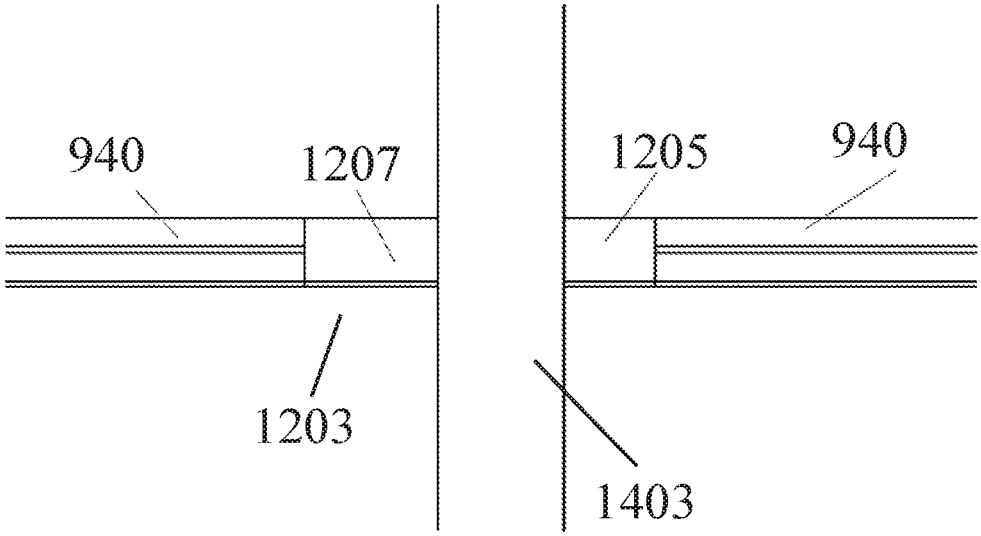
FIG. 14 illustrates an exemplary power strip system in application in accordance with some embodiments of this disclosure.

FIG. 14 illustrates an exemplary power strip system in accordance with some embodiments of this disclosure. The power strip system may include one or more strip connectors 1203 and one or more power outlet strips 940. In some embodiments, strip connector 1203 may bypass an obstacle to establish connection between power outlet strips 940 on both sides of the obstacle. Strip connector 1203 may include a connecting joint 1205 and a connecting interface 1207. Strip connector 1203 may bypass obstacle 1403 through the structure in shape of " ⎍ ".

Figure 15:
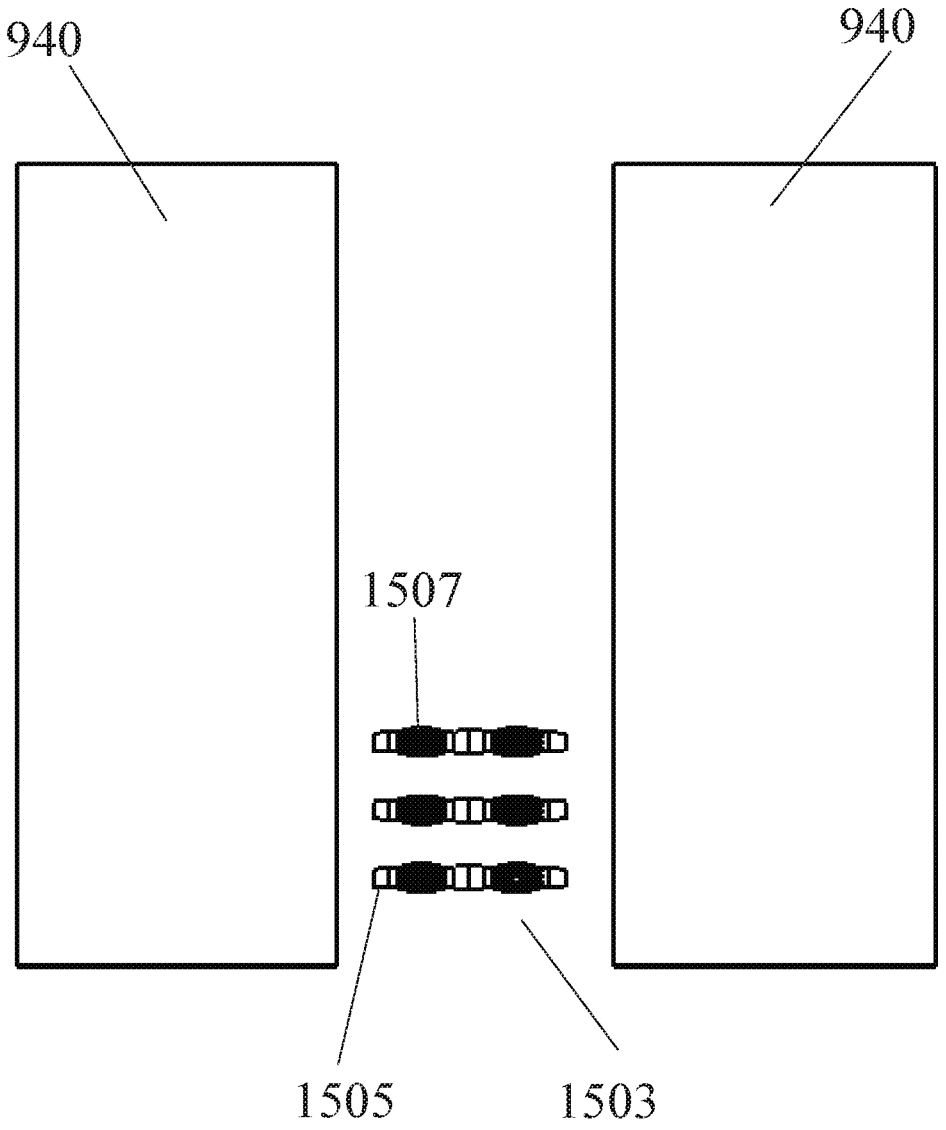
FIG. 15 illustrates an exemplary linear power strip system in application in accordance with some embodiments of this disclosure.

FIG. 15 illustrates an exemplary linear power strip system in accordance with some embodiments of this disclosure. The linear power strip system may include one or more power outlet strip 940 and one or more strip connectors 1503. In some embodiments, the length of a power outlet strip 940 may between 1 meter and 10 meters. In some embodiments, the length of a power outlet strip 940 may between 1 meter and 5 meters. In some embodiments, the length of power outlet strip 940 may between 1 meter and 3 meters.

In some embodiments, power outlet strip 940 may be positioned along the trims of a room. The length of trims of the room may be greater than the length of one or more power outlet strips 940. In that way, multiple power outlet strips 940 may be needed to be positioned along the trims. In some embodiments, strip connector 1503 may connect two adjacent power outlet strips 940 to establish an electrical connection between them.

In some embodiments, strip connector 1503 may include one or more conductors 1505. The number of conductors 1505 may be equal to or less than the number of conductors in power outlet strip 940. One or more connectors 1507 may be positioned in the middle section of the conductors 1505. In some embodiments, connector 1507 may be a lantern-shaped connector. Connector 1507 may tighten the connection between strip connector 1503 and power outlet strip 940.

Figure 16A:
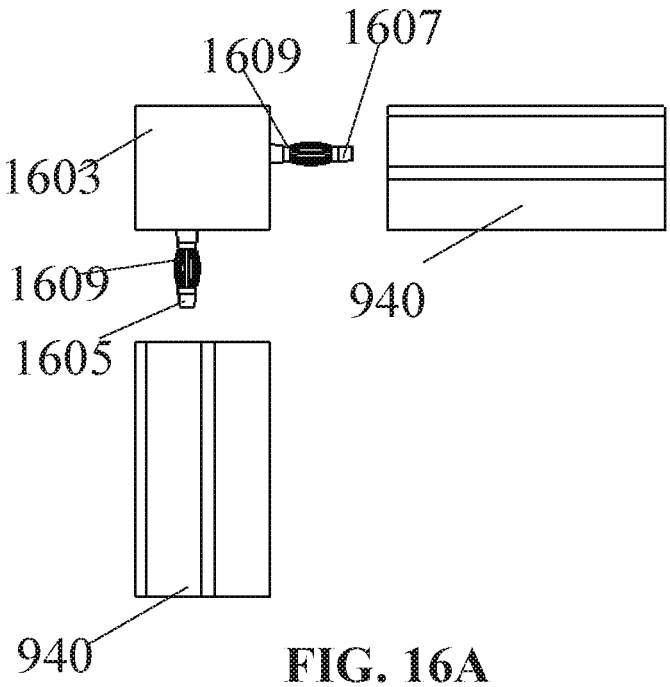
FIG. 16A illustrates an exemplary female angled power strip system in accordance with some embodiments of this disclosure.

FIG. 16A illustrates a top view of an exemplary female angled power strip system. The female angled power strip system may include one or more power outlet strip 940 and one or more female angled strip connectors 1603. In some embodiments, a female angle may refer to a depressed corner of walls, such as, the angle of two walls in the room. In some embodiments, power outlet strip 940 that longitudinally extend along the trims of one wall in a room may come across an female angle and be needed to connect to another power outlet strip 940 located on the trims of another wall. Female angled strip connector 1603 may be configured to connect the two power outlet strips 940.

In some embodiments, a female angled strip connector 1603 may include one or more first conductors 1605 and one or more second conductors 1607. The number of first conductors 1605 and the number of second conductors 1607 may be equal to or less than the number of conductors in power outlet strip 940. The number of first conductors 1605 and the number of second conductors 1607 may or may not be the same. The plurality of first conductors 1605 and second conductors 1607 may respectively be arranged in vertical lines, therefore there may be only one first conductor 1605 and one second conductor 1607 in the top view in FIG. 16A.

In some embodiments, female angled strip connector 1603 may be a cuboid, a cube, or an object with curved shape, etc. First conductor 1605 and second conductor 1607 may extend from two adjacent surfaces of female angled strip connector 1603. First conductor 1605 and second conductor 1607 may be perpendicular with each other. One or more connectors 1609 may be positioned in the middle section of first conductor 1605 and second conductor 1607. Connectors 1609 may tighten the connection between female angled strip connector 1603 and power outlet strip 940.

Figure 16B:
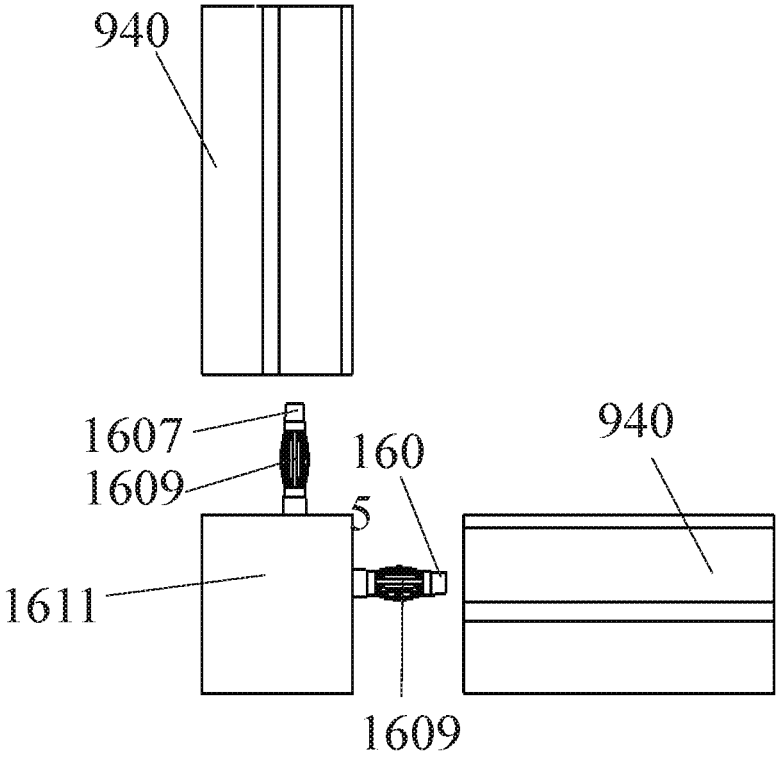
FIG. 16B illustrates an exemplary male angled power strip system in accordance with some embodiments of this disclosure.

FIG. 16B illustrates a top view of an exemplary male angled power strip system 1620. The male angled power strip system 1620 may include one or more power outlet strips 940 and one or more male angled strip connectors 1611. In some embodiments, a male angle may refer to a protuberant corner of walls, such as, the angle of a turning point of indoor path. The way that male angled connector 1611 connect adjacent power outlet strips 940 is similar to that of female angled connector.

Many alternatives, modifications, and variations will be apparent to those skilled in the art. For example, although the implementation of various components described above may be embodied in a hardware device, it may also be implemented as a software only solution—e.g., an installation on an existing server or mobile device. Besides, the providing of location information may be embodied in a firmware device, a combination of firmware devices and software devices, a combination of firmware devices and hardware devices, or a combination of firmware devices, hardware devices and software devices.

The disclosure and/or a variety of embodiments have been illustrated above. Various alterations may occur according to the above descriptions. The claimed subject matter may be implemented by various ways and embodiments, and may be implemented in various applications. All applications suggested by the following claims and other alterations, improvements, and modifications are within the spirit and scope of this disclosure.

What is claimed is:

1. A power strip system, comprising:

a power outlet strip, wherein the power outlet strip comprises at least two conductors; and a strip connector, wherein the strip connector is configured to establish a connection between the power outlet strip and at least one other power outlet strip, wherein the power outlet strip comprises at least one groove, and the at least two conductors are positioned in the groove, wherein the strip connector comprises a connecting joint and a connecting interface, the connecting joint comprises a first conductor, the connecting interface comprises a second conductor matching the first conductor, and the first conductor is a conducting bar and the second conductor is a conducting tube.

2. The power strip system of claim 1, wherein the connecting joint comprises a first bending part and a first strip connector part, and wherein the first bending part and the first strip connector part are perpendicularly connected.

3. The power strip system of claim 2, wherein the first strip connector part is connected to the power outlet strip via a third conductor.

4. The power strip system of claim 3, wherein the third conductor is a conducting bar.

5. The power strip system of claim 1, wherein the connecting interface comprises a second buckle and a second strip connector part, wherein the second conductor is positioned on a first end of the second buckle, and wherein a second end of the second buckle and the second strip connector are perpendicularly connected.

6. The power strip system of claim 5, wherein a first end of the second strip connector comprises a cavity, wherein a fourth conductor configured to connect to the power outlet strip is positioned in the cavity, and wherein the second strip connector is connected to the power outlet strip via the cavity.

7. The power strip system of claim 6, wherein the forth conductor is a conducting bar.

8. The power strip system of claim 1, wherein the conducting bar comprises a lantern-shaped connector, wherein a diameter of a lantern-shaped connector is larger than a diameter of a edge of first conductor.

9. The power strip system of claim 1, wherein a cross sectional area of the first conductor and the second conductor is within a range of 5.0 $mm^2$~7.0 $mm^2$.

10. A power outlet system, comprising:

a socket, comprising:

a housing having a front side, a back side, and a clamping conducting strip positioned inside of the housing; and a plug releasably connected to outside of the housing having a connector and at least two elastic conducting contacts positioned on a surface of the plug configured to connect to a power source; and a power strip system, comprising:

a power outlet strip, wherein the power outlet strip comprises at least two conductors and a strip connector, wherein the at least two conductors are configured to connect to the elastic conducting contacts when the plug is configured to be inserted into the power outlet strip, wherein the strip connector comprises a connecting joint and a connecting interface, the connecting joint comprises a first conductor, the connecting interface comprises a second conductor matching the first conductor, and the first conductor is a conducting bar and the second conductor is a conducting tube.

11. The power outlet system of claim 10, wherein the strip connector is configured to establish a connection between the power outlet strip and at least one other power outlet strip, wherein the power outlet strip comprises at least one groove, and the at least two conductors are positioned in the groove.

12. The power outlet system of claim 11, wherein the connecting joint comprises a first bending part and a first strip connector part, and wherein the first buckle and the first strip connector are perpendicularly connected.

13. The power outlet system of claim 11, wherein the connecting interface comprises a second bending part and a second strip connector part, wherein the second conductor is positioned on a first end of the second buckle, and wherein a second end of the second buckle and the second strip connector are perpendicularly connected.

14. The power outlet system of claim 13, wherein a first end of the second strip connector part comprises a cavity, wherein a fourth conductor configured to connect to the power outlet strip is positioned in the cavity, and wherein the second strip connector is connected to the power outlet strip via the cavity.

15. The power outlet system of claim 10, wherein the housing of the socket further includes:

a connecting groove positioned on the back side of the housing; an inner contact point positioned in the connecting groove and connected to the clamping conducting strip;

an external contact point positioned on the connector and connected to the elastic conducting contacts, and at least one of a slot or a hole positioned on the front side of the housing and the clamping conducting strip is accessible through the at least one of a slot or a hole positioned on the front side of the housing, wherein the connector of the plug is configured to be inserted into the connecting groove such that the inner contact point forms contact with the external contact point to enable the clamping conducting strip to be conductive with the elastic conducing contacts.

* * * * *